US012753715B2

(12) United States Patent
Kim et al.

(10) Patent No.: US 12,753,715 B2
(45) Date of Patent: Oct. 6, 2026

(54) APPARATUS FOR DIAGNOSING A POST-PROCESSING SYSTEM

(71) Applicants: HYUNDAI MOTOR COMPANY, Seoul (KR); KIA CORPORATION, Seoul (KR); AVL SOFTWARE AND FUNCTIONS GMBH, Regensburg (DE)

(72) Inventors: Kangjin Kim, Hwaseong-si (KR); Dong Hee Han, Hwaseong-si (KR); Jong Il Park, Hwaseong-si (KR); Jonghyeok Lee, Hwaseong-si (KR); Minkyu Park, Hwaseong-si (KR); Hyunjin Kang, Hwaseong-si (KR); Olivier Pioch, Regensburg (DE)

(73) Assignees: HYUNDAI MOTOR COMPANY, Seoul (KR); KIA CORPORATION, Seoul (KR); AVL SOFTWARE AND FUNCTIONS GMBH, Regensburg (DE)

( * ) Notice: Subject to any disclaimer, the term of this patent is extended or adjusted under 35 U.S.C. 154(b) by 0 days.

(21) Appl. No.: 19/271,650

(22) Filed: Jul. 16, 2025

(65) Prior Publication Data

US 2026/0168423 A1 Jun. 18, 2026

(30) Foreign Application Priority Data

Dec. 12, 2024 (KR) ..... 10-2024-0185058

(51) Int. Cl.
*F01N 11/00* (2006.01)

(52) U.S. Cl.
CPC ..... *F01N 11/00* (2013.01); *F01N 2550/06* (2013.01); *F01N 2900/1404* (2013.01)

(58) Field of Classification Search
CPC ..... F01N 11/00; F01N 11/002; F01N 9/00; F01N 2550/02; F01N 2550/06;
(Continued)

(56) References Cited

U.S. PATENT DOCUMENTS 6,276,138 B1 * 8/2001 Welch ..... F02D 17/02 123/198 F
7,363,761 B1 * 4/2008 Dickerson ..... F02B 37/22 60/602

(Continued)

*Primary Examiner* — Dapinder Singh
(74) *Attorney, Agent, or Firm* — Lempia Summerfield Katz LLC

(57) ABSTRACT

An apparatus for diagnosing a post-processing system includes a first catalyst, an exhaust heat recovery system, and a second catalyst sequentially disposed on an exhaust line. The apparatus further includes a main bypass line, an auxiliary bypass line, a first bypass valve, and a second bypass valve. The apparatus further includes a controller configured to determine whether a first temperature sensor configured to measure a temperature of an exhaust gas on an upstream side of the first bypass valve, a second temperature sensor configured to measure a temperature of the exhaust gas on an upstream side of the exhaust heat recovery system, a third temperature sensor configured to measure a temperature of the exhaust gas on the downstream side of the exhaust heat recovery system, the first bypass valve, and the second bypass valve are abnormal, depending on whether a predetermined diagnosis condition is satisfied.

20 Claims, 19 Drawing Sheets

(58) Field of Classification Search
CPC ..... F01N 2900/1404; F01N 2900/0601; F01N 2900/08; F01N 2900/1602; F01N 2900/1614; Y02T 10/12; Y02T 10/40
See application file for complete search history.

(56) References Cited

U.S. PATENT DOCUMENTS

| | | | | |
|---|---|---|---|---|
| 7,490,462 | B2 * | 2/2009 | Roozenboom | F02M 26/15 123/562 |
| 8,516,814 | B2 * | 8/2013 | Okada | F01N 13/009 60/602 |
| 10,697,388 | B2 * | 6/2020 | Zielinski | F02D 41/2441 |
| 2008/0000228 | A1 * | 1/2008 | Kieser | F02M 26/42 60/605.1 |
| 2010/0139269 | A1 * | 6/2010 | Heyes | F02B 37/004 60/287 |
| 2016/0115883 | A1 * | 4/2016 | Mischler | F02D 41/1467 123/703 |

* cited by examiner

APPARATUS FOR DIAGNOSING A POST-PROCESSING SYSTEM

CROSS-REFERENCE TO RELATED APPLICATION

This application claims priority to and the benefit of Korean Patent Application No. 10-2024-0185058, filed with the Korean Intellectual Property Office on Dec. 12, 2024, the entire contents of which is incorporated herein by reference.

BACKGROUND

Technical Field

The present disclosure relates to an apparatus for diagnosing a post-processing system.

Description of the Related Art

There is a trend in which the number of vehicles applied with a traditional internal combustion engine is decreasing and the number of electric vehicles or hybrid vehicles with low exhaust emission is increasing, according to global exhaust emission regulations.

Among them, the hybrid vehicle is a vehicle using two or more power sources such as engines and drive motors.

Since these hybrid vehicles have a drive motor that assists the engine's power, the engines used in hybrid vehicles are mostly operated at the highest thermal efficiency operating point (or optimum operating point). When low-temperature combustion is achieved using lean burn combustion mode at the highest thermal efficiency operating point, the combustion temperature is lowered, which increases the specific heat ratio and improves the efficiency of the hybrid vehicle.

In accordance with emission regulations, vehicles are installed with catalytic converters that purify various harmful substances contained in exhaust gases.

A three-way catalyst (TWC) reduces carbon monoxide (CO), hydrocarbon (HC), and nitrogen oxides (NOx) in the exhaust gas of a gasoline engine. The three-way catalyst is activated above a certain temperature, converting CO and HC into harmless components through oxidation reactions and NOx into harmless components through reduction reactions. These three-way catalysts have high thermal efficiency and low nitrogen oxide emission characteristics when the engine is operated in theoretical air-fuel ratio mode.

However, when the engine is operated in the lean burn mode, the nitrogen oxide purification efficiency of the three-way catalyst deteriorates rapidly. Although the nitrogen oxide emissions are low when the engine is operated in a lean burn mode, the nitrogen oxide emissions increase because the purification efficiency of the three-way catalyst is very low.

Due to these problems, additional catalytic converters such as lean NOx trap (LNT) and/or selective catalytic reduction (SCR) are used to reduce exhaust gases containing nitrogen oxides in engines that apply lean burn mode.

LNT absorbs nitrogen oxides that are not purified by the three-way catalyst under lean operating conditions, and reduces absorbed nitrogen oxides to nitrogen ($N_2$) and releases them under rich operating conditions.

SCR is a catalyst that purifies ammonia and nitrogen oxides into nitrogen and water by reacting them on a catalyst. Although the method of injecting urea solution to supply ammonia ($NH_3$) is widely used, a method of purifying nitrogen oxides without urea by using $NH_3$ generated from LNT in conjunction with LNT (e.g. passive SCR) is also being used.

However, LNT's nitrogen oxide purification efficiency varies greatly depending on the temperature of the catalyst, and shows the highest purification efficiency between 250 and 350 degrees Celsius. On the other hand, at high temperatures (e.g., above 450 degrees Celsius), LNT catalysts are vulnerable, so nitrogen oxides are released without being reduced.

For gasoline engines, the exhaust gas temperature exceeds 900 degrees Celsius under full-load operating conditions, which deteriorates the purification efficiency of the LNT, but it is necessary to maintain the temperature of the LNT at an appropriate level in a lean burn mode.

Therefore, a post-processing system suitable for lean burn engines is being developed. These post-processing systems are equipped with various precision parts, and a method is required to diagnose whether the various parts are operating normally while the post-processing system is in operation.

The matters described in the description of the related art are prepared to enhance the understanding of the background of the disclosure, and may include matters that are not already known to those having ordinary skill in the art to which the present technology belongs.

SUMMARY

The present disclosure provides an apparatus for diagnosing a post-processing system, capable of diagnosing whether a component part applied to a post-processing system of a lean burn engine is abnormal.

In an embodiment of the present disclosure, an apparatus for diagnosing a post-processing system may include a first catalyst, an exhaust heat recovery system, and a second catalyst disposed on an exhaust line. The apparatus further includes a main bypass line branched from the exhaust line between the first catalyst and the exhaust heat recovery system and joining to the exhaust line on a downstream side of the second catalyst. The apparatus further includes an auxiliary bypass line branched from the exhaust line between the first catalyst and the exhaust heat recovery system and joining to the exhaust line between the exhaust heat recovery system and the second catalyst. The apparatus further includes a first bypass valve installed at a location where the exhaust line and the main bypass line join and a second bypass valve installed at a location where the exhaust line and the auxiliary bypass line join. The apparatus further includes a controller configured to determine whether at least one of a first temperature sensor, a second temperature sensor, a third temperature sensor, the first bypass valve, or the second bypass valve is abnormal, based on whether a predetermined diagnosis condition is satisfied. The first temperature sensor is configured to measure a temperature of an exhaust gas on an upstream side of the first bypass valve, the second temperature sensor is configured to measure a temperature of the exhaust gas on an upstream side of the exhaust heat recovery system, and the third temperature sensor configured to measure a temperature of the exhaust gas on the downstream side of the exhaust heat recovery system.

The predetermined diagnosis condition may include a preliminary diagnosis condition for verifying validity of the first temperature sensor to the third temperature sensor. The predetermined diagnosis condition may further include a first diagnosis condition for diagnosing whether the first temperature sensor is abnormal, a second diagnosis condition for diagnosing whether the second temperature sensor is abnormal, a third diagnosis condition for diagnosing whether the third temperature sensor is abnormal, a fourth diagnosis condition for diagnosing whether the first bypass valve is abnormal, and a fifth diagnosis condition for diagnosing whether the exhaust heat recovery system is abnormal.

The preliminary diagnosis condition may be satisfied when a stop duration of an engine is greater than or equal to a predetermined time. The first diagnosis condition is satisfied when the temperature measured by the first to third temperature sensors while the preliminary diagnosis condition is satisfied is preliminarily verified to be valid, and the engine is under operation. The second diagnosis condition is satisfied when the first temperature sensor is determined to be normal, the engine is under operation, and the temperature of the exhaust gas on the upstream side of the first bypass valve is higher than or equal to a first predetermined temperature, while the first diagnosis condition is satisfied. The third diagnosis condition is satisfied when the second temperature sensor is determined to be normal, the engine is under operation, and the temperature of the exhaust gas on the upstream side of the exhaust heat recovery system is higher than or equal to a second predetermined temperature, and the first bypass valve is opened, while the second diagnosis condition is satisfied. The fourth diagnosis condition is satisfied when the third temperature sensor is determined to be normal, the engine is under operation, and the temperature of the exhaust gas on the upstream side of the exhaust heat recovery system is higher than or equal to third predetermined temperature, while the third diagnosis condition is satisfied. The fifth diagnosis condition is satisfied when the first bypass valve and the second temperature sensor are determined to be normal, the engine is under operation, and the temperature of the exhaust gas on the upstream side of the exhaust heat recovery system is higher than or equal to third predetermined temperature, while the fourth diagnosis condition is satisfied.

When the first diagnosis condition is satisfied, the controller may be configured to determine whether the first temperature sensor is abnormal by comparing a difference between the temperature of the exhaust gas measured by the first temperature sensor and a modeling temperature.

When the difference between the temperature of the exhaust gas measured by the first temperature sensor and the modeling temperature is smaller than a second comparison temperature, the controller may determine the first temperature sensor to be normal.

When the difference between the temperature of the exhaust gas measured by the first temperature sensor and the modeling temperature is greater than or equal to the second comparison temperature, the controller may determine the first temperature sensor to be abnormal.

When the second diagnosis condition is satisfied, the controller may determine whether the second temperature sensor is abnormal by comparing the temperature of the exhaust gas measured by the first temperature sensor with the temperature of the exhaust gas measured by the second temperature sensor.

When the temperature of the exhaust gas measured by the first temperature sensor is higher than or equal to the temperature of the exhaust gas measured by the second temperature sensor, the controller may determine the second temperature sensor to be normal.

When the temperature of the exhaust gas measured by the first temperature sensor is lower than the temperature of the exhaust gas measured by the second temperature sensor, the controller may determine the second temperature sensor to be abnormal.

When the third diagnosis condition is satisfied, the controller may be configured to compare the temperature of the exhaust gas measured by the second temperature sensor with the temperature of the exhaust gas measured by the third temperature sensor, to determine whether the third temperature sensor is abnormal.

When the temperature of the exhaust gas measured by the second temperature sensor is higher than or equal to the temperature of the exhaust gas measured by the third temperature sensor, the controller may determine the third temperature sensor to be normal.

When the temperature of the exhaust gas measured by the second temperature sensor is lower than the temperature of the exhaust gas measured by the third temperature sensor, the controller may determine the third temperature sensor to be abnormal.

When the fourth diagnosis condition is satisfied, the controller may be configured to apply a control signal to close the first bypass valve, compare the temperature of the exhaust gas measured by the first temperature sensor with the temperature of the exhaust gas measured by the second temperature sensor, compare the temperature of the exhaust gas measured by the second temperature sensor with the temperature of the exhaust gas measured by the third temperature sensor, and determine whether the first bypass valve and the second temperature sensor are abnormal.

When a difference between the temperature of the exhaust gas measured by the first temperature sensor and the temperature of the exhaust gas measured by the second temperature sensor is smaller than a third comparison temperature, and a difference between the temperature of the exhaust gas measured by the second temperature sensor and the temperature of the exhaust gas measured by the third temperature sensor is greater than or equal to a fourth comparison temperature, the controller may determine the first bypass valve to be normal.

When a difference between the temperature of the exhaust gas measured by the first temperature sensor and the temperature of the exhaust gas measured by the second temperature sensor is greater than or equal to a third comparison temperature, and a difference between the temperature of the exhaust gas measured by the second temperature sensor and the temperature of the exhaust gas measured by the third temperature sensor is smaller than a fourth comparison temperature, the controller may determine the first bypass valve to be abnormal.

When a difference between the temperature of the exhaust gas measured by the first temperature sensor and the temperature of the exhaust gas measured by the second temperature sensor is greater than or equal to a third comparison temperature and a difference between the temperature of the exhaust gas measured by the second temperature sensor and the temperature of the exhaust gas measured by the third temperature sensor is greater than or equal to a fourth comparison temperature, the controller may determine the second temperature sensor to be abnormal.

When the fifth diagnosis condition is satisfied, the controller may determine whether the second bypass valve and the third temperature sensor are abnormal based on the temperature of the exhaust gas measured by the third temperature sensor range.

When the temperature of the exhaust gas measured by the third temperature sensor is lower than a fifth comparison temperature and higher than or equal to a sixth comparison temperature, the controller may be configured to determine that the exhaust heat recovery system is normal.

When the temperature of the exhaust gas measured by the third temperature sensor is lower than a fifth comparison temperature and higher than or equal to a sixth comparison temperature, the controller may determine the second bypass valve to be abnormal.

When the temperature of the exhaust gas measured by the third temperature sensor is lower than a sixth comparison temperature, the controller may determine the third temperature sensor to be abnormal.

According to an embodiment of the present disclosure, whether the first to third temperature sensors and the first and second bypass valves are abnormal can be diagnosed based on the first to third measured temperatures.

Other effects that may be obtained or are predicted by an embodiment of the present disclosure are explicitly or implicitly described in a detailed description of the present disclosure. In other words, various effects that are predicted according to an embodiment of the present disclosure are described in the following detailed description.

BRIEF DESCRIPTION OF THE DRAWINGS

These drawings are for reference in describing an embodiment of the present disclosure, and the technical spirit of the present disclosure should not be construed as being limited to the accompanying drawings.

Figure 1:
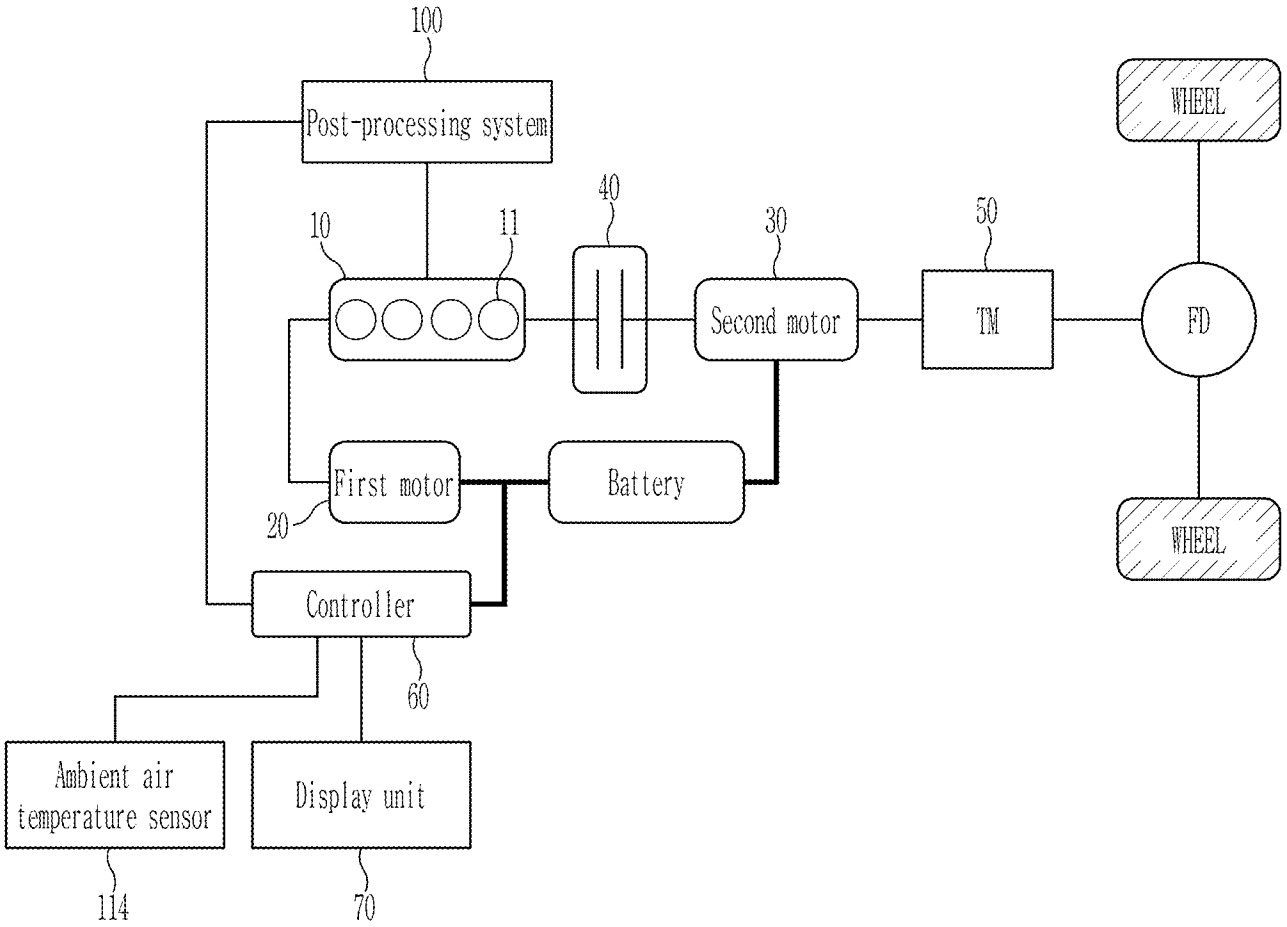
FIG. 1 is a schematic view showing a configuration of the vehicle to which a post-processing system according to an embodiment of the present disclosure is applied.

It should be understood that the above-referenced drawings may not necessarily be to scale, presenting a somewhat simplified representation of various example features illustrative of the basic principles of the disclosure. The specific design features of the present disclosure, including, for example, specific dimensions, orientations, locations, and shapes, are determined in part by the particular intended application and use environment.

DETAILED DESCRIPTION

The terminology used herein is for the purpose of describing particular embodiments only and is not intended to be limiting of the present disclosure. As used herein, the singular forms are intended to include the plural forms as well, unless the context clearly indicates otherwise. It should be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any one or all combinations of one or more related items.

When a component, controller, device, element, apparatus, or the like of the present disclosure is described as having a purpose or performing an operation, function, or the like, the component, controller, device, element, apparatus, or the like should be considered herein as being "configured to" meet that purpose or to perform that operation or function. Each component, controller, device, element, apparatus, and the like may separately embody or be included with a processor and a memory, such as a non-transitory computer readable media, as part of the apparatus.

In the present disclosure, each of phrases such as "A or B", "at least one of A and B", "at least one of A or B", "A, B or C", "at least one of A, B and C", "at least one of A, B or C" and "at least one of A, B, or C, or a combination thereof" may include any one or all possible combinations of the items listed together in the corresponding one of the phrases.

Additionally, it is understood that one or more of the below methods, or aspects thereof, may be executed by at least one controller. The term "controller" may refer to a hardware device that includes a memory and a processor. The memory is configured to store program instructions, and the processor is specifically programmed to execute the program instructions to perform one or more processes which are described further below. The controller may control operation of units, modules, parts, devices, or the like, as described herein. Moreover, it is understood that the below methods may be executed by an apparatus comprising the controller in conjunction with one or more other components, as would be appreciated by a person having ordinary skill in the art.

Furthermore, the controller of the present disclosure may be embodied as non-transitory computer readable media containing executable program instructions executed by a processor. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed throughout a computer network so that the program instructions are stored and executed in a distributed fashion, e.g., by a telematics server or a Controller Area Network (CAN).

The present disclosure is described more fully hereinafter with reference to the accompanying drawings, in which embodiments of the present disclosure are illustrated. As those having ordinary skill in the art would realize, the described embodiments may be modified in various different ways, all without departing from the spirit or scope of the present disclosure.

The drawings and description are to be regarded as illustrative in nature and not restrictive, and like reference numerals designate like elements throughout the specification.

In addition, the size and thickness of each configuration shown in the drawings may be arbitrarily shown for understanding and ease of description, but the present disclosure is not limited thereto, and the thickness of layers, films, panels, regions, and the like, may be exaggerated for clarity.

Suffixes, "module" and/or "unit" for a constituent element used for the description below are given or mixed in consideration of only easiness of the writing of the specification, and the suffix itself does not have a discriminated meaning or role.

Further, in describing the embodiment disclosed in the present disclosure, when it is determined that detailed description relating to well-known functions or configurations may make the subject matter of the embodiment disclosed in the present disclosure unnecessarily ambiguous, the detailed description will be omitted.

Further, the accompanying drawings are provided for helping to easily understand embodiments disclosed in the present specification, and the technical spirit disclosed in the present specification is not limited by the accompanying drawings, and it should be appreciated that the present disclosure includes all of the modifications, equivalent matters, and substitutes included in the spirit and the technical scope of the present disclosure.

Terms including ordinal numbers such as first, second, and the like are used only to describe various components, and are not interpreted as limiting these components.

As used herein, the singular forms "a", "an" and "the" are intended to include the plural forms as well, unless the context clearly indicates otherwise.

The terms are only used to differentiate one component from others.

Hereinafter, a diagnosis apparatus of a post-processing system according to an embodiment of the present disclosure is described in detail with reference to the accompanying drawings.

A vehicle applied with a post-processing apparatus of an engine according to an embodiment of the present disclosure is described in detail.

FIG. 1 is a schematic view showing a configuration of the vehicle to which a post-processing system according to an embodiment of the present disclosure is applied.

As shown in FIG. 1, a vehicle applied with a post-processing system according to an embodiment of the present disclosure may include an engine 10, a first motor 20, a second motor 30, a clutch 40, and a controller 60.

The engine 10 may include a plurality of cylinders 11 configured to generate the power required for driving the vehicle by combustion of fuel. In an embodiment of the present disclosure, the engine 10 may be a gasoline engine 10.

The first motor 20 may start the engine 10, and as needed, may selectively operate as a generator, to generate electrical energy. The first motor 20 may be a kind of integrated starter-generator.

The second motor 30 may generate power required for driving the vehicle, and as needed, may assist the power of the engine 10. In addition, the second motor 30 may selectively operate as a generator, to generate electrical energy.

The clutch 40 may be provided between the engine 10 and the second motor 30, and depending on engagement of the clutch 40, the hybrid vehicle may drive in an electric vehicle (EV) mode or in a hybrid electric vehicle (HEV) mode.

The electric vehicle (EV) mode may be a mode in which the vehicle drives with only the power of the second motor 30, and the hybrid electric vehicle (HEV) mode may be a mode in which the vehicle drives with the power of the engine 10 and the power of the second motor 30.

The power output from the engine 10 and the second motor 30 may be transferred to drive wheels provided in the vehicle. A transmission 50 may be provided between the clutch 40 and drive wheel.

Shifting gears are installed inside the transmission 50, and depending on the shifting gears, the power output by the engine 10 and the second motor 30 may be changed.

The controller 60 may control the components of the hybrid vehicle, which includes the engine 10, the first motor 20, the second motor 30, the clutch 40, and a post-processing system 100 to be described below.

Depending on whether a predetermined diagnosis condition is satisfied, the controller 60 may perform a diagnosis process diagnosing whether component parts of the post-processing system 100 (e.g., a first temperature sensor 111, a second temperature sensor 112, a third temperature sensor 113, a first bypass valve 121, and a second bypass valve 131) are abnormal.

The controller 60 may be provided as at least one processor executed by a predetermined program, and the predetermined program is configured to perform respective steps of a control method of the ignition apparatus according to an embodiment of the present disclosure.

Various hazardous substances contained in the exhaust gas discharged from the engine 10 may be purified through the post-processing system 100, and may be discharged to the air through a tail pipe, after attenuating its noise while passing through a muffler.

Figure 2:
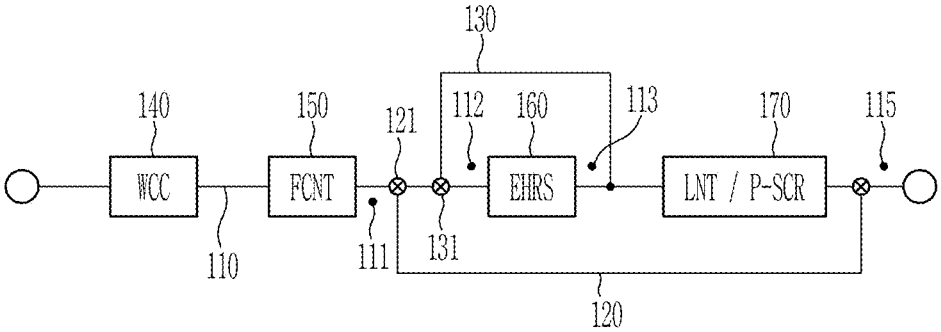
FIG. 2 is a block diagram showing a configuration of a post-processing system according to an embodiment of the present disclosure.

FIG. 2 is a block diagram showing a configuration of a post-processing system according to an embodiment of the present disclosure.

Referring to FIG. 2, the post-processing system 100 according to an embodiment of the present disclosure may include a warming-up catalytic converter (WCC) catalyst 140, fuel cut NOx trap (FCNT) catalyst 150, and lean NOx trap (LNT) catalyst 170, sequentially disposed along an exhaust line 110.

The WCC catalyst 140, the FCNT catalyst 150, and the LNT catalyst 170 may purify the hazardous substances included in the exhaust gas discharged through the exhaust line 110. The WCC catalyst 140, the FCNT catalyst 150, and the LNT catalyst 170 may be sequentially disposed along the flow direction of the exhaust gas flowing through the exhaust line 110.

An exhaust heat recovery system (EHRS) 160 may be disposed on the exhaust line 110 between the FCNT catalyst 150 and the LNT catalyst 170. The exhaust heat recovery system 160 may be a type of heat-exchanger, and may recollect the heat included in the exhaust gas discharged from the combustion chamber of the engine through the operation fluid (e.g., coolant).

A lambda sensor 115 may be provided on the exhaust line 110, and through an oxygen concentration of the exhaust gas measured through the lambda sensor 115, a controller 60 may determine an air/fuel ratio of the engine (AFR).

A plurality of bypass lines 120 and 130 detouring the exhaust heat recovery system 160 and the LNT catalyst 170 may be provided on the exhaust line 110 along which the exhaust gas discharged from the engine 10 flows. The plurality of bypass lines 120 and 130 may include a main bypass line 120 and an auxiliary bypass line 130.

The main bypass line 120 may be branched from the exhaust line 110 between the FCNT catalyst 150 and the exhaust heat recovery system 160, and may join at the exhaust line 110 on a downstream side of the LNT catalyst 170. The first bypass valve 121 may be installed at a location where the exhaust line 110 and the main bypass line 120 join. The first bypass valve 121 may be implemented as a 3-way valve. The first bypass valve 121 may be implemented as an electronic valve capable of adjusting its opening.

Depending on the opening and closing of the first bypass valve 121 operated by the controller 60, the exhaust gas having passed through the WCC catalyst 140 and the FCNT catalyst 150 may pass through the LNT catalyst 170 disposed on the exhaust line 110, or may selectively flow through the main bypass line 120 detouring the LNT catalyst 170. In other words, depending on the opening and closing of the first bypass valve 121, the exhaust gas may pass through or detour the LNT catalyst 170.

The auxiliary bypass line 130 may be branched from the exhaust line 110 between the FCNT catalyst 150 and the exhaust heat recovery system 160, and may join at the exhaust line 110 between the exhaust heat recovery system 160 and the LNT catalyst 170. The second bypass valve 131 may be installed at a location where the exhaust line 110 and the auxiliary bypass line 130 join. The second bypass valve 131 may be implemented as a 3-way valve. The second bypass valve 131 may be implemented as an electronic valve capable of adjusting its opening.

Depending on the opening and closing of the second bypass valve 131 operated by the controller 60, the exhaust gas having passed through the WCC catalyst 140 and the FCNT catalyst 150 may pass through the exhaust heat recovery system 160 installed on the exhaust line 110, or may selectively flow through the auxiliary bypass line 130 detouring the exhaust heat recovery system 160. In other words, depending on the opening and closing of the second bypass valve 131, the exhaust gas may pass through or detour the exhaust heat recovery system 160.

In an embodiment of the present disclosure, the controller 60 may control the operation of the first bypass valve 121 and the second bypass valve 131, to change a discharge path of the exhaust gas. In other words, according to an operation of the first bypass valve 121 and the second bypass valve 131, the discharge path of the exhaust gas may be selectively determined as one of a first discharge path to a third discharge path.

Figure 3:
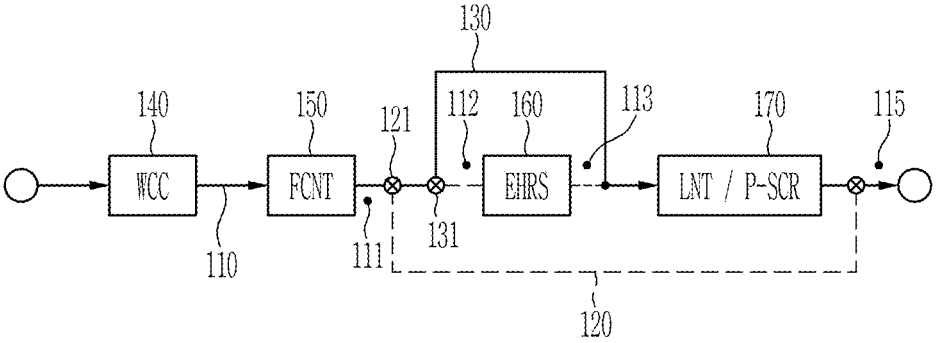
FIGS. 3-5 are operation diagrams for explaining an operation of a post-processing system according to an embodiment of the present disclosure.

When the controller 60 opens the first bypass valve 121 and opens the second bypass valve 131, the exhaust gas having passed through the WCC catalyst 140 and the FCNT catalyst 150 may detour the exhaust heat recovery system 160, pass through the LNT catalyst 170, and then be discharged to the air through the muffler. In an embodiment of the present disclosure, such a path of the exhaust gas may be referred to as the first discharge path (see FIG. 3). The first discharge path may be used in a warm-up mode for heating the LNT catalyst 170.

Figure 4:
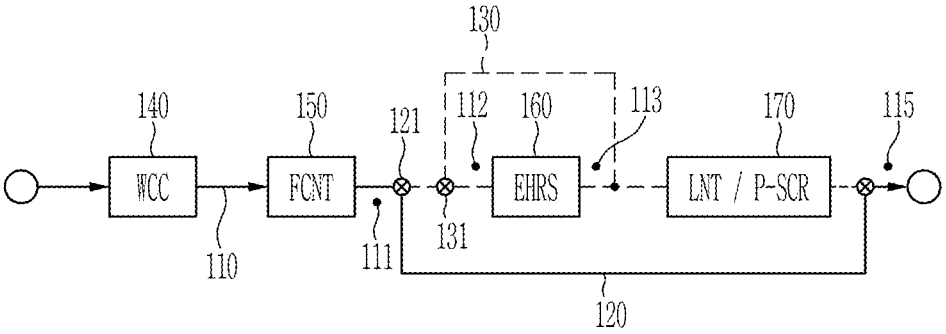

When the controller 60 blocks the first bypass valve 121 and opens the second bypass valve 131, the exhaust gas having passed through the WCC catalyst 140 and the FCNT catalyst 150 may detour the exhaust heat recovery system 160 and the LNT catalyst 170, and then may be discharged to the air through the muffler. In an embodiment of the present disclosure, such a path of the exhaust gas may be referred to as a second discharge path (see FIG. 4). The second discharge path may be used when the engine operates in a theoretical air/fuel ratio area.

Figure 5:
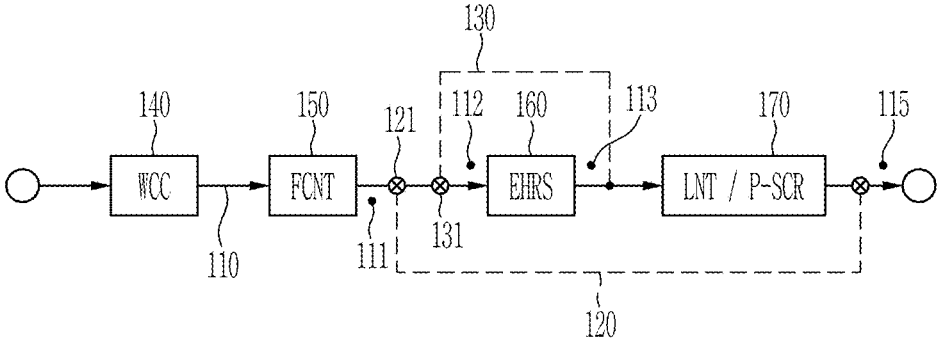

When the controller 60 opens the first bypass valve 121 and blocks the second bypass valve 131, the exhaust gas having passed through the WCC catalyst 140 and the FCNT catalyst 150 may pass through the exhaust heat recovery system 160 and the LNT catalyst 170, and then may be discharged to the air through the muffler. In an embodiment of the present disclosure, such a path of the exhaust gas is referred to as the third discharge path (see FIG. 5). The third discharge path may be used to recollect the exhaust heat through the exhaust heat recovery system 160, when the LNT catalyst 170 is overheated by the high-temperature exhaust gas.

A post-processing system according to an embodiment of the present disclosure may include a first temperature sensor 111 configured to measure the temperature of the exhaust gas flowing through the exhaust line 110 on an upstream side of the first bypass valve 121, a second temperature sensor 112 configured to measure the temperature of the exhaust gas flowing through the exhaust line 110 on an upstream side of the exhaust heat recovery system 160, the third temperature sensor 113 configured to measure the temperature of the exhaust gas flowing through an exhaust line 110 on the downstream side of the exhaust heat recovery system 160, and an ambient air temperature sensor 114 configured to measure the ambient air temperature.

The first temperature sensor 111 may be installed on the exhaust line 110 on the upstream side of the first bypass valve 121 and may measure the temperature of the exhaust gas flowing through the exhaust line 110 on the upstream side of the first bypass valve 121, and the temperature of the exhaust gas measured by the first temperature sensor 111 may be transmitted to the controller 60. Hereinafter, if necessary, the temperature of the exhaust gas measured by the first temperature sensor 111 may be referred to as a first measured temperature.

The second temperature sensor 112 may be installed on the exhaust line 110 on the upstream side of the exhaust heat recovery system 160 and may measure the temperature of the exhaust gas flowing through the exhaust line 110 on the upstream side of the exhaust heat recovery system 160, and the temperature of the exhaust gas measured by the second temperature sensor 112 may be transmitted to the controller 60. Hereinafter, if necessary, the temperature of the exhaust gas measured by the second temperature sensor 112 may be referred to as a second measured temperature.

The third temperature sensor 113 may be installed on the exhaust line 110 on the downstream side of the exhaust heat recovery system 160, and when the temperature of the exhaust gas flowing through the exhaust line 110 on the downstream side of the exhaust heat recovery system 160 is measured, the temperature of the exhaust gas measured by the third temperature sensor 113 may be transmitted to the controller 60. Hereinafter, if necessary, the temperature of the exhaust gas measured by the third temperature sensor 113 may be referred to as a third measured temperature.

The ambient air temperature sensor 114 may measure the ambient air temperature, and the ambient air temperature measured by the ambient air temperature sensor 114 may be transmitted to the controller 60.

Depending on whether a predetermined diagnosis condition (a first diagnosis condition to a fifth diagnosis condition) is satisfied, the controller 60 may determine whether the first temperature sensor 111, the second temperature sensor 112, the third temperature sensor 113, the first bypass valve 121, and the exhaust heat recovery system 160 are abnormal, and may display whether the first temperature sensor 111, the second temperature sensor 112, the third temperature sensor 113, the first bypass valve 121, and the exhaust heat recovery system 160 are normal and/or abnormal, through a display unit 70.

The controller 60 may be implemented to include one or more processors that operate according to a preset program, and a memory of the controller may store program instructions programmed to perform each step of a method for diagnosing a post-processing system provided with a motor according to the disclosure through one or more processors.

Hereinafter, a method for diagnosing a post-processing system according to an embodiment of the present disclosure is described in detail with reference to the drawings.

Figure 6:
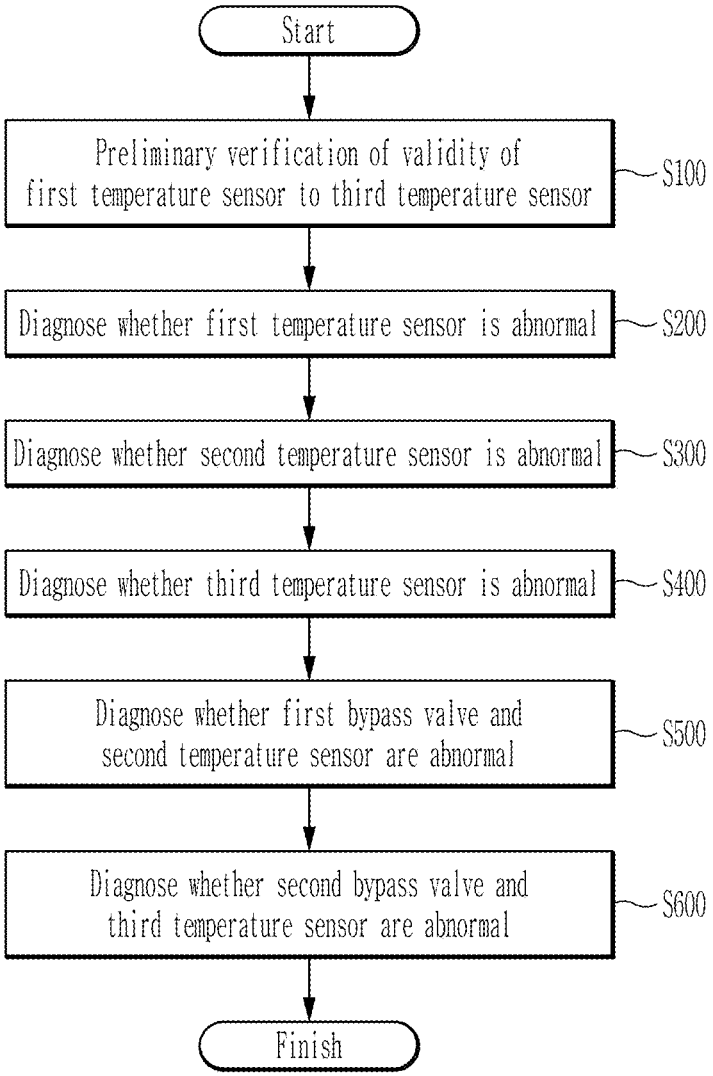
FIG. 6 is a flowchart showing a method for diagnosing a post-processing system according to an embodiment of the present disclosure.

FIG. 6 is a flowchart showing a method for diagnosing a post-processing system according to an embodiment of the present disclosure.

Referring to FIG. 6, when the preliminary diagnosis condition is satisfied, the controller 60 may preliminarily determine the validity of the first temperature sensor 111 to the third temperature sensor 113, at step S100.

When the first diagnosis condition is satisfied, the controller 60 may determine whether the first temperature sensor 111 is abnormal, at step S200.

When a second diagnosis condition is satisfied, the controller 60 may determine whether the second temperature sensor 112 is abnormal, at step S300.

When a third diagnosis condition is satisfied, the controller 60 may determine whether the third temperature sensor 113 is abnormal, at step S400.

When a fourth diagnosis condition is satisfied, the controller 60 may determine whether the first bypass valve 121 and the second temperature sensor 112 are abnormal, at step S500.

When the fifth diagnosis condition is satisfied, the controller 60 may determine whether the second bypass valve 131 and the third temperature sensor 113 are abnormal, at step S600.

Hereinafter, each diagnosis process is described in detail.

Figure 7:
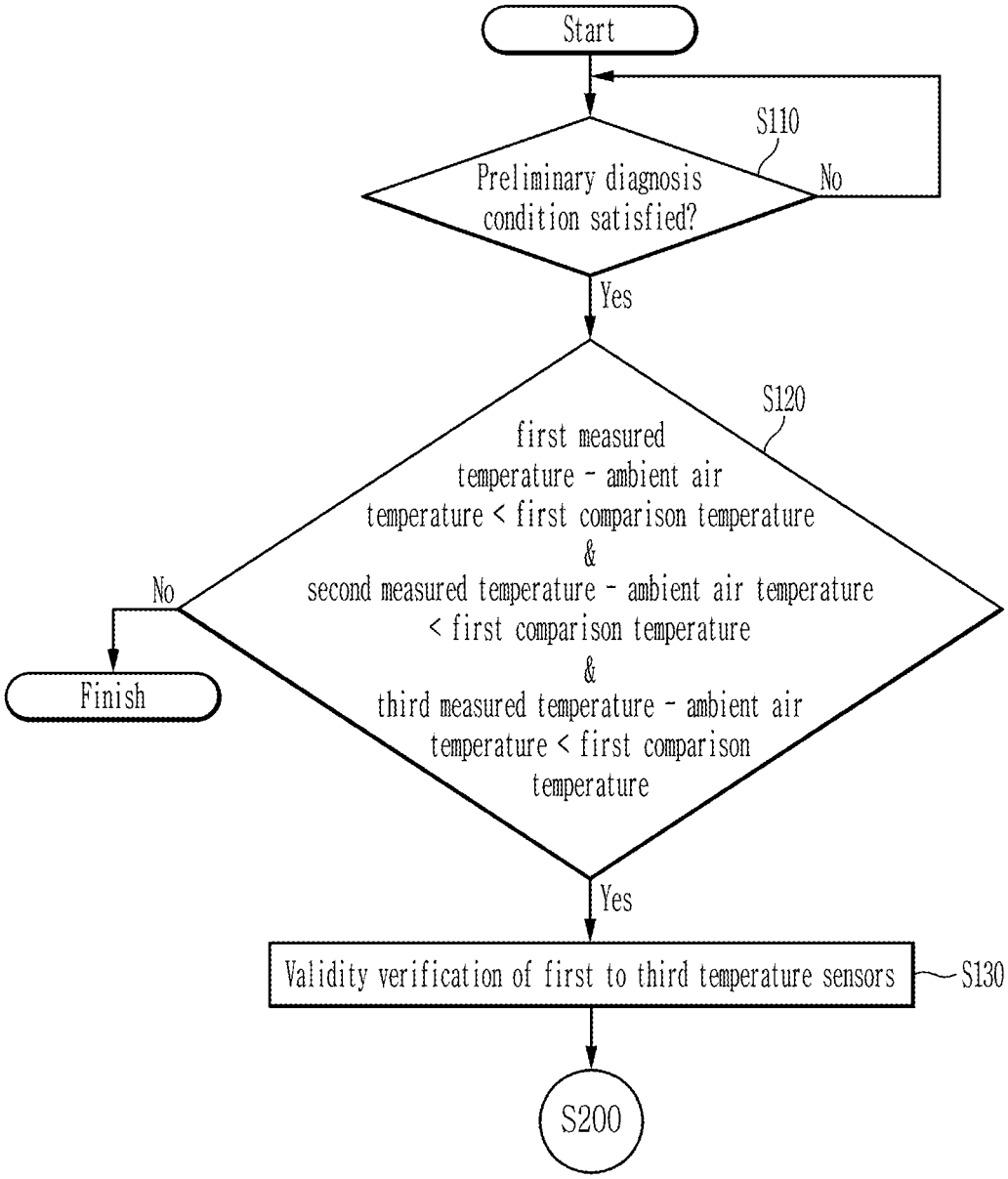
FIG. 7 is a flowchart showing a method of preliminarily verifying validity of a first temperature sensor to a third temperature sensor of a post-processing system according to an embodiment of the present disclosure.

Referring to FIG. 7, the controller 60 may determine whether a preliminary diagnosis condition is satisfied, at step S110. The preliminary diagnosis condition is to preliminarily verify validity (i.e., plausibility) with respect to the temperature of the exhaust gas measured by the first temperature sensor 111, the second temperature sensor 112, and the third temperature sensor 113, and may be satisfied when the stop duration of the engine is greater than or equal to a predetermined time (e.g., 300 minutes).

When the preliminary diagnosis condition is satisfied, the controller 60 may compare first to the third measured temperatures and the ambient air temperature measured by the ambient air temperature sensor 114, at step S120.

Figure 8A:
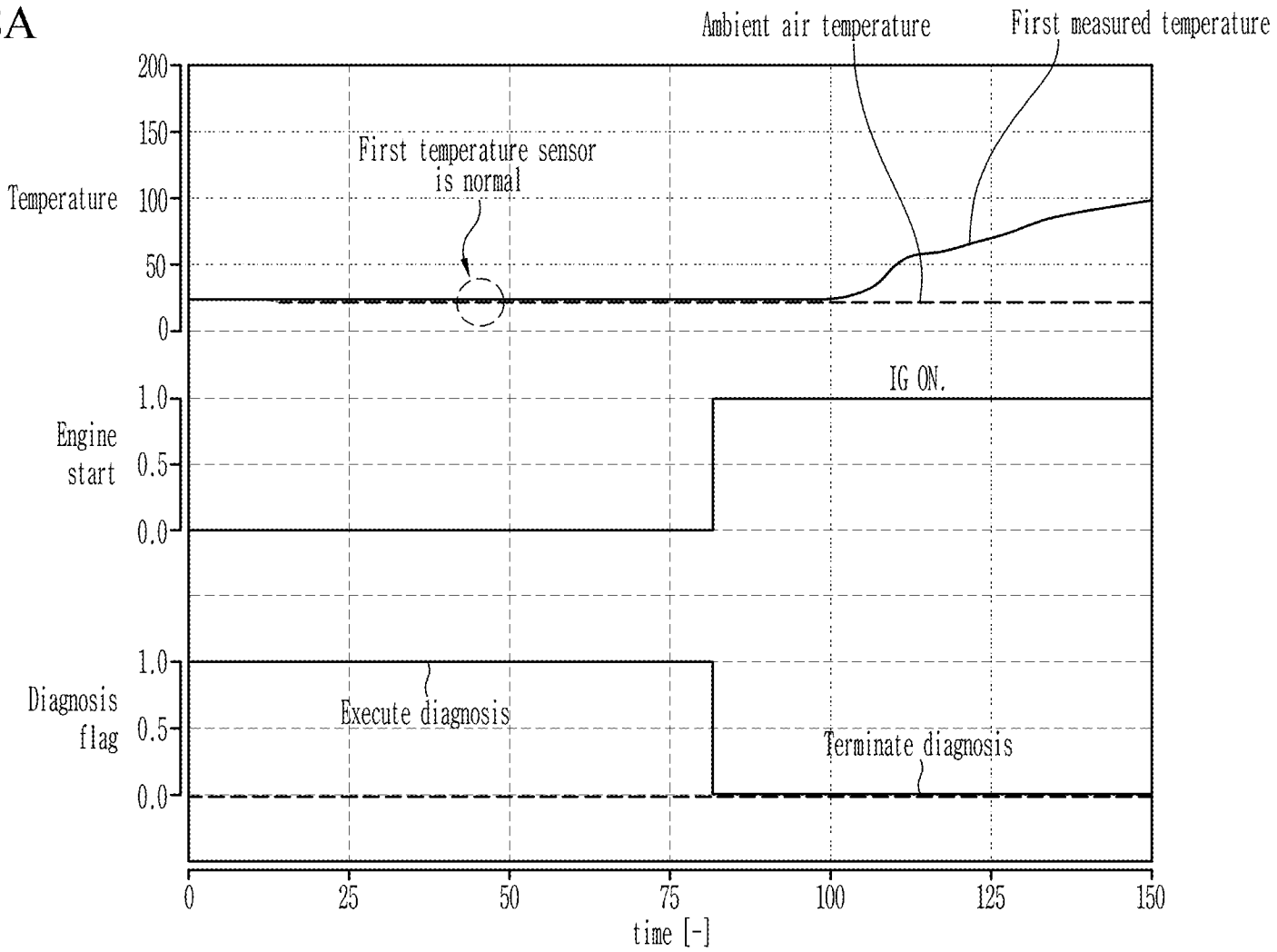
FIGS. 8A-8B are graphs explaining the diagnosis method of FIG. 7.

When the difference between each of the first to the third measured temperatures and the ambient air temperature measured by the ambient air temperature sensor 114 is smaller than a first comparison temperature (e.g., 10 degrees Celsius), the controller 60 may preliminarily determine that the temperatures measured by respective temperature sensors (first to third temperature sensors 111, 112, and 113) are valid, at step S130 (see FIG. 8A), and may perform subsequent diagnosis processes.

Figure 8B:
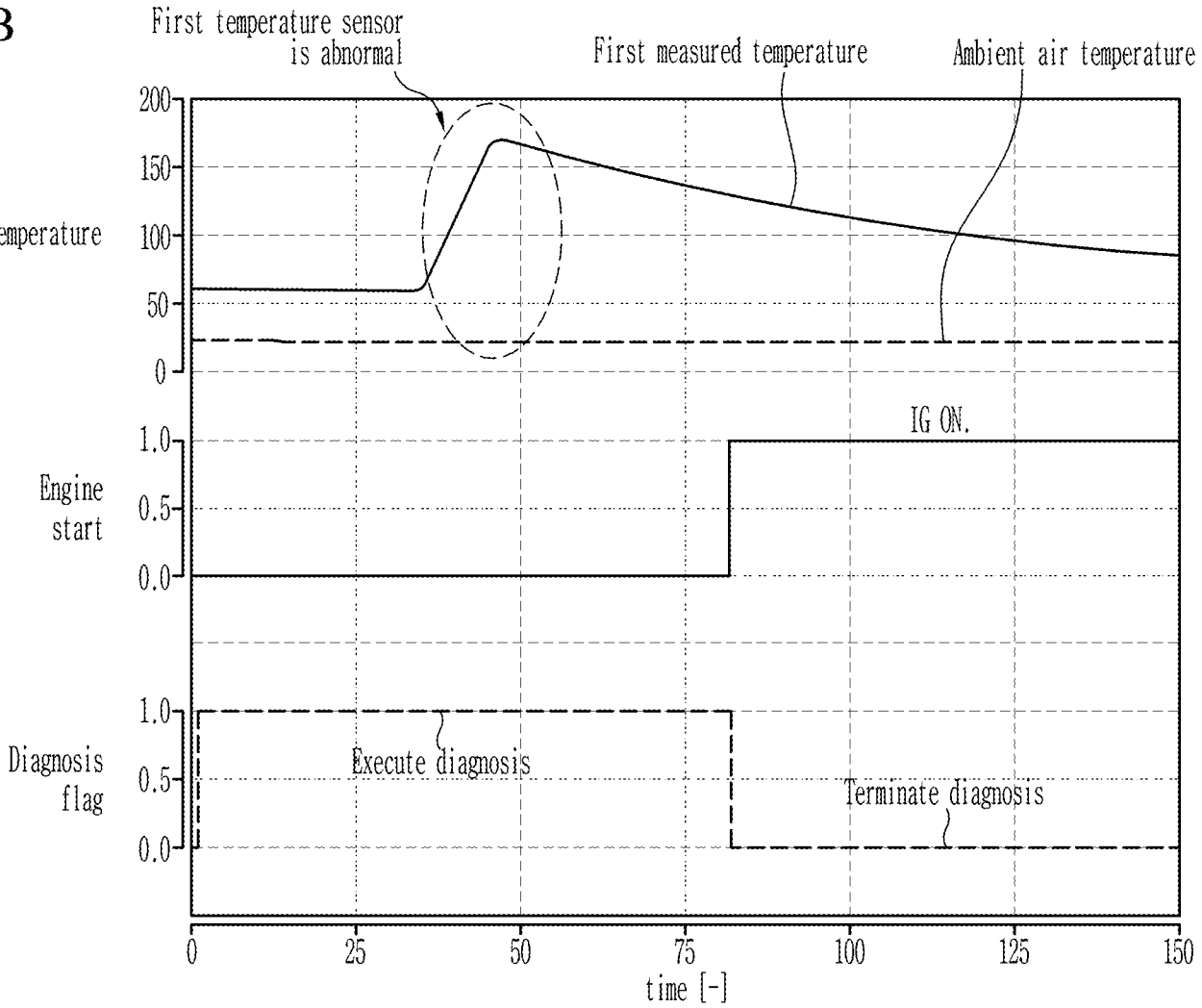

When the difference between the first to the third measured temperatures and the ambient air temperature measured by the ambient air temperature sensor 114 is greater than or equal to the first comparison temperature, the controller 60 may determine that the temperature measured by the corresponding temperature sensor is not valid (see FIG. 8B), and may terminate the diagnosis process.

Figure 9:
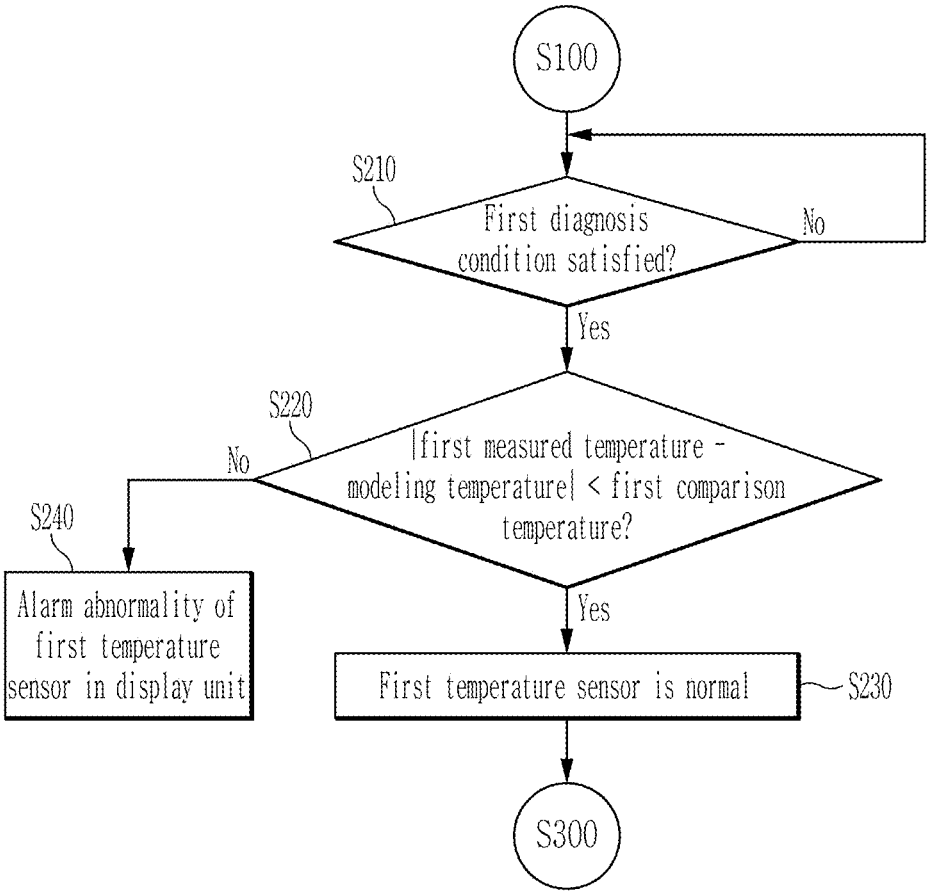
FIG. 9 is a flowchart showing a method of diagnosing whether a first temperature sensor of a post-processing system according to an embodiment of the present disclosure is abnormal.

Referring to FIG. 9, the controller 60 may determine whether the first diagnosis condition is satisfied, at step S210. The first diagnosis condition is to diagnose whether the first temperature sensor 111 is abnormal, and may be satisfied when the temperature measured by the first temperature sensor 111 to the third temperature sensor 113 while the preliminary diagnosis condition is satisfied is preliminarily verified to be valid, and the engine is under operation.

When the first diagnosis condition is satisfied, the controller 60 may determine whether the first temperature sensor 111 is abnormal based on the first measured temperature and a modeling temperature.

For such a purpose, the controller 60 may compare the first measured temperature and the modeling temperature, at step S220. The modeling temperature may be the temperature of the exhaust gas on the upstream side of the first bypass valve 121 that is determined based on an engine speed, an engine load, and an engine operation time, and may be experimentally determined. The modeling temperature may be stored in the controller 60 in advance.

A difference between when the first measured temperature and the modeling temperature is lower than a second comparison temperature (e.g., 50 degrees Celsius), the controller 60 may determine that the first temperature sensor 111 is normal, at Step S230.

When the difference between the first measured temperature and the modeling temperature is greater than or equal to the second comparison temperature (e.g., 50 degrees Celsius), the controller 60 may determine the first temperature sensor 111 to be abnormal, at step S240. The controller 60 may notify a driver, through the display unit 70, that an abnormality of the first temperature sensor 111 has occurred.

Figure 10:
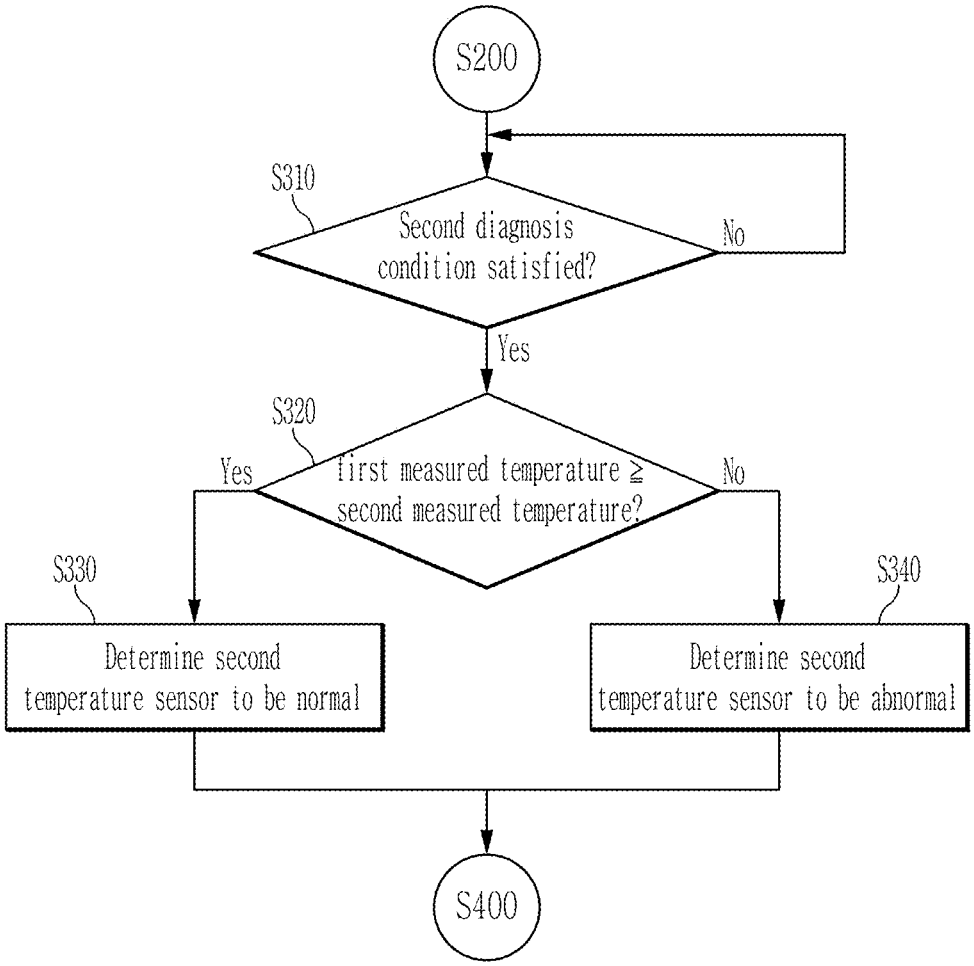
FIG. 10 is a flowchart showing a method of diagnosing whether a second temperature sensor of a post-processing system according to an embodiment of the present disclosure is abnormal.

Referring to FIG. 10, the controller 60 may determine whether the second diagnosis condition is satisfied, at step S310. The second diagnosis condition is to diagnose whether the second temperature sensor 112 is abnormal, and may be satisfied when the first temperature sensor 111 is determined to be normal while the first diagnosis condition is satisfied, the engine is under operation, and the temperature of the exhaust gas on the upstream side of the first bypass valve 121 is higher than or equal to a first predetermined temperature (e.g., 200 degrees Celsius). The reason of determining whether the temperature on the upstream side of the first bypass valve 121 is higher than or equal to the first predetermined temperature is to determine whether the engine is sufficiently warmed-up.

When the second diagnosis condition is satisfied, the controller 60 may determine whether the second temperature sensor 112 is abnormal based on the first measured temperature and the second measured temperature.

For such a purpose, the controller 60 may compare the first measured temperature and the second measured temperature, at step S320.

When the first measured temperature is higher than or equal to the second measured temperature, the controller 60 may determine that the second temperature sensor 112 is normal, at step S330.

When the first measured temperature is lower than the second measured temperature, the controller 60 may determine the second temperature sensor 112 to be abnormal, at step S340. The controller 60 may notify the driver that an abnormality has occurred in the second temperature sensor 112, through the display unit 70.

Since the first temperature sensor 111 is located on an upstream side of the second temperature sensor 112 based on the flow direction of the exhaust gas, the second measured temperature must be lower than the first measured temperature. However, when the first measured temperature is higher than the second measured temperature, the controller 60 may determine that an abnormality has occurred in the second temperature sensor 112.

Figure 11:
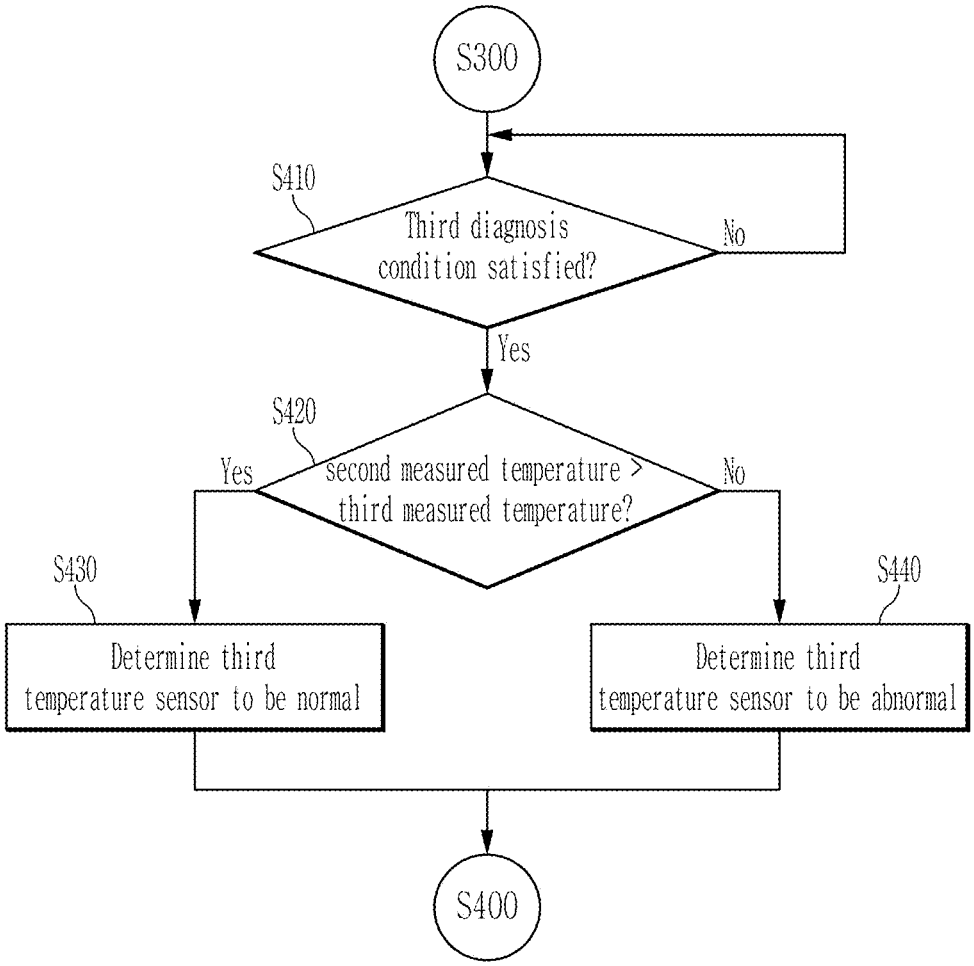
FIG. 11 is a flowchart showing a method of diagnosing whether a third temperature sensor of a post-processing system according to an embodiment of the present disclosure is abnormal.

Referring to FIG. 11, the controller 60 may determine whether the third diagnosis condition is satisfied, at step S410. The third diagnosis condition is to determine whether the third temperature sensor 113 is abnormal, and may be satisfied when, the second temperature sensor 112 is determined to be normal while the second diagnosis condition is satisfied, the engine is under operation, the temperature of the exhaust gas on the upstream side of the exhaust heat recovery system 160 is higher than or equal to a second predetermined temperature (e.g., 200 degrees Celsius), and the first bypass valve 121 is opened.

The reason of determining whether the temperature of the exhaust gas flowing through the exhaust line on the upstream side of the exhaust heat recovery system 160 is higher than or equal to the predetermined temperature (e.g., 200 degrees Celsius) is to determine whether the engine is sufficiently warmed-up.

When the third diagnosis condition is satisfied, the controller 60 may determine whether the third temperature sensor 113 is abnormal based on the second measured temperature and the third measured temperature.

For such a purpose, the controller 60 may compare the second measured temperature and the third measured temperature, at step S420.

When the second measured temperature is higher than or equal to the third measured temperature, the controller 60 may determine that the third temperature sensor 113 is normal, at step S430.

When the second measured temperature is lower than the third measured temperature, the controller 60 may determine the third temperature sensor 113 to be abnormal, at step S440. The controller 60 may notify the driver that an abnormality has occurred in the third temperature sensor 113, through the display unit 70.

Since the second temperature sensor 112 is located on an upstream side of the third temperature sensor 113 based on the flow direction of the exhaust gas, the third measured temperature must be lower than the second measured temperature. However, when the second measured temperature is higher than the third measured temperature, the controller 60 may determine that an abnormality has occurred in the third temperature sensor 113.

Figure 12:
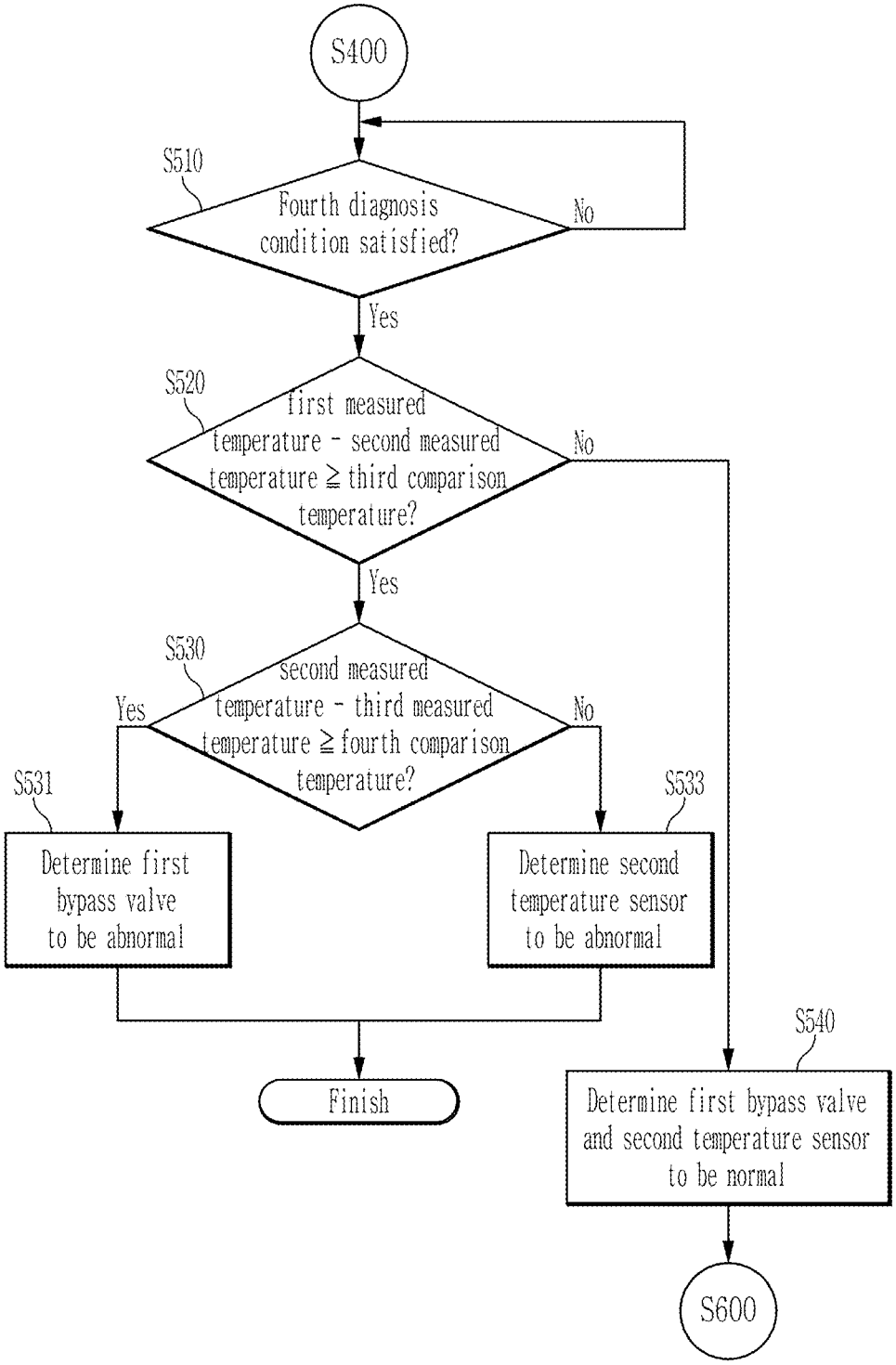
FIG. 12 is a flowchart showing a method of diagnosing whether a first bypass valve and second temperature sensor of a post-processing system according to an embodiment of the present disclosure are abnormal.

Referring to FIG. 12, the controller 60 may determine whether the fourth diagnosis condition is satisfied, at step S510. The fourth diagnosis condition is to diagnose whether the first bypass valve 121 is abnormal (e.g., whether the first bypass valve 121 is stuck or closed), and whether the second temperature sensor 112 is abnormal, and may be satisfied when the third temperature sensor 113 determined to be normal while the third diagnosis condition is satisfied, the engine is under operation, and the temperature of the exhaust gas on the upstream side of the exhaust heat recovery system 160 is higher than or equal to a third predetermined temperature (e.g., 300 degrees Celsius).

When the fourth diagnosis condition is satisfied, the controller 60 may apply a control signal to open the first bypass valve 121, and may diagnose whether the first bypass valve 121 and the second temperature sensor 112 are abnormal, based on the first measured temperature, the second measured temperature, and the third measured temperature.

For such a purpose, the controller 60 may compare the first measured temperature and the second measured temperature, at step S520, and may compare the second measured temperature and the third measured temperature, at step S530.

Figure 13A:
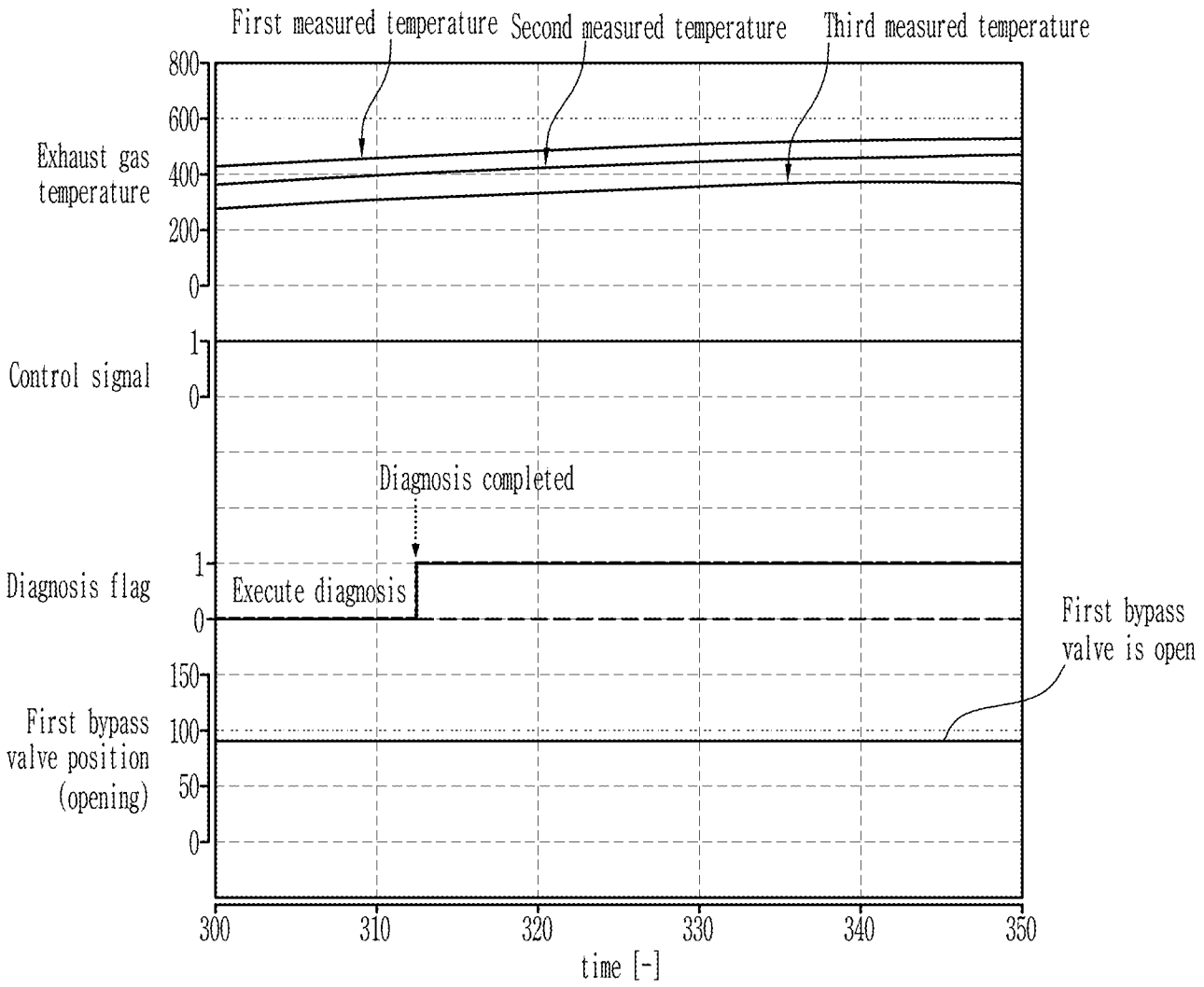
FIGS. 13A-13B are graphs explaining the diagnosis method of FIG. 12.

When a difference between the first measured temperature and the second measured temperature is lower than a third comparison temperature (e.g., 180 degrees Celsius), the controller 60 may determine that the first bypass valve 121 and the second temperature sensor 112 is normal, at step S540 (see FIG. 13A).

When the difference between the first measured temperature and the second measured temperature is lower than the third comparison temperature (e.g., 180 degrees Celsius), the controller 60 may apply a control signal to open the first bypass valve 121.

Figure 13B:
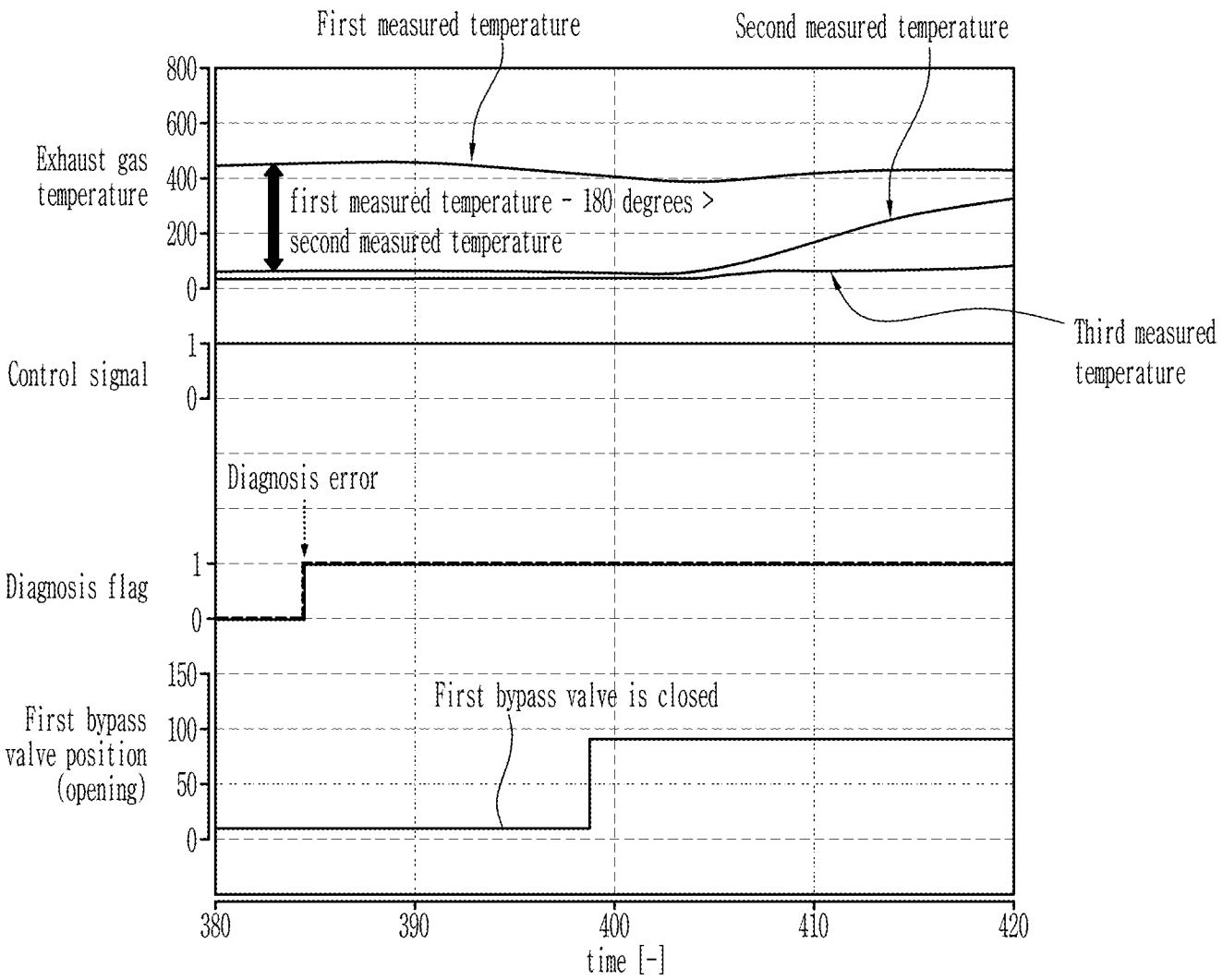

When the difference between the first measured temperature and the second measured temperature is greater than or equal to the third comparison temperature, and the difference between the third measured temperature and the second measured temperature is lower than a fourth comparison temperature (or, when a difference between the temperature of the exhaust gas on the upstream side of the exhaust heat recovery system 160 and the temperature of the exhaust gas on the downstream side of the exhaust heat recovery system 160 is not large), the controller 60 may determine that the first bypass valve 121 is stuck or closed, at step S531 (see FIG. 13B). The controller 60 may notify the driver that an abnormality has occurred in the first bypass valve 121, through the display unit 70.

When the first bypass valve 121 is operated to be open, the difference between the first measured temperature and the second measured temperature should not be large. Therefore, when the difference between the first measured temperature and the second measured temperature is greater than or equal to the third comparison temperature, the controller 60 may provisionally determine that an abnormality has occurred in one of the first bypass valve 121 or the second temperature sensor 112.

When a control signal is applied by the controller 60 to open the first bypass valve 121, the first bypass valve 121 is opened so that the exhaust gas must be introduced from the upstream side of the first bypass valve 121 into the upstream side of the exhaust heat recovery system 160. However, when the third measured temperature and the second measured temperature are lower than the fourth comparison temperature, this may mean that a difference between the upstream side and the downstream side of the exhaust heat recovery system 160 is small. In this case, the controller 60 may determine that the first bypass valve 121 is stuck or closed and the exhaust gas detours the exhaust heat recovery system 160.

When the difference between the first measured temperature and the second measured temperature is greater than or equal to the third comparison temperature, and the difference between the third measured temperature and the second measured temperature is greater than or equal to the fourth comparison temperature (or, when the temperature of the exhaust gas on the downstream side of the exhaust heat recovery system 160 is higher than the temperature of the exhaust gas on the upstream side of the exhaust heat recovery system 160), the controller 60 may determine that an abnormality has occurred in the second temperature sensor 112, at step S533.

When a control signal is applied by the controller 60 to open the first bypass valve 121, since the first bypass valve 121 is opened so that the exhaust gas passes through the exhaust heat recovery system 160, the temperature of the exhaust gas on the downstream side of the exhaust heat recovery system 160 must be lower than the temperature of the exhaust gas on the upstream side of the exhaust heat recovery system 160. However, when the difference between the temperature of the exhaust gas on the upstream side of the exhaust heat recovery system 160 and the temperature of the exhaust gas on the downstream side of the exhaust heat recovery system 160 is greater than or equal to the fourth comparison temperature, this may mean that the second measured temperature is abnormally low. In this case, the controller 60 may determine that an abnormality has occurred in the second temperature sensor 112.

Figure 14:
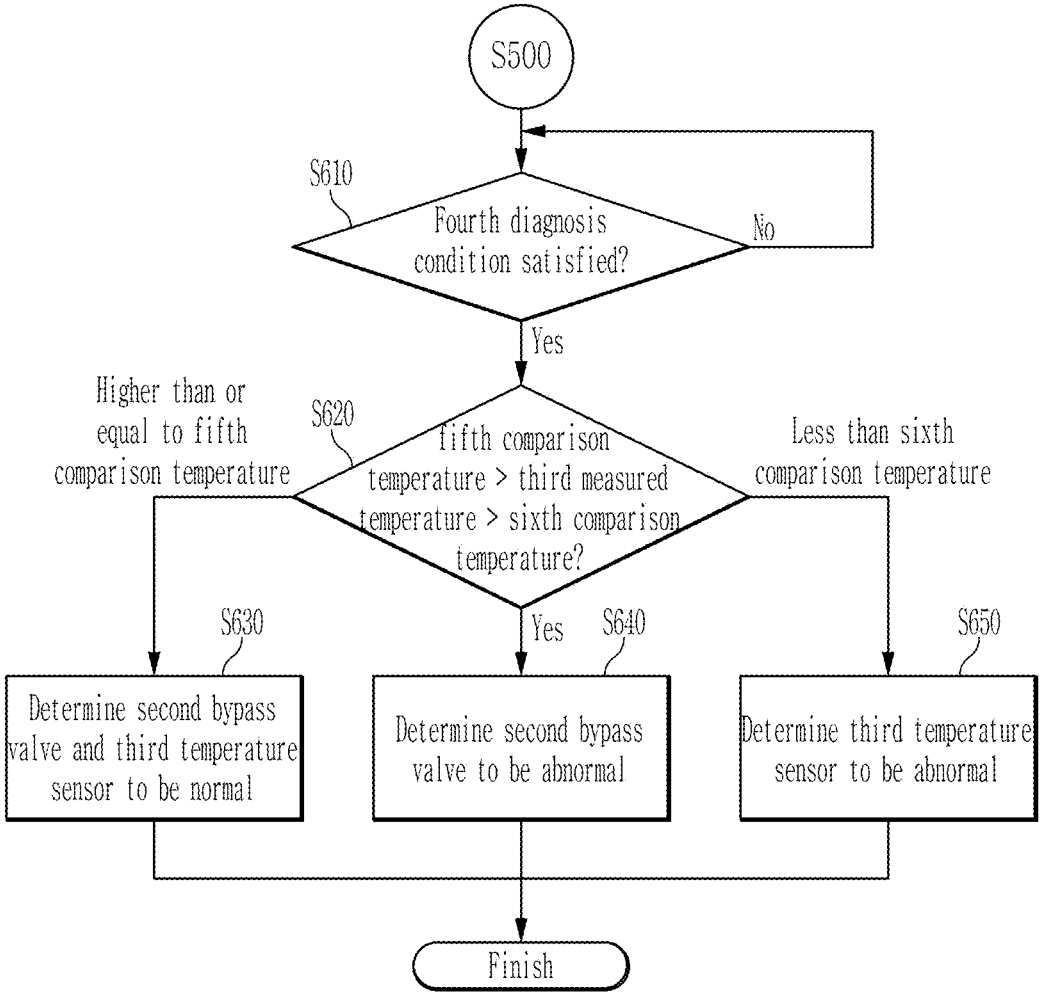
FIG. 14 is a flowchart showing a method of diagnosing whether a second bypass valve and a third temperature sensor of a post-processing system according to an embodiment of the present disclosure are abnormal.

Referring to FIG. 14, the controller 60 may determine whether the fifth diagnosis condition is satisfied, at step S610. The fifth diagnosis condition is to diagnose whether the second bypass valve 131 and the third temperature sensor 113 are abnormal, and may be satisfied when the first bypass valve 121 and the second temperature sensor 112 are determined to be normal while the fourth diagnosis condition is satisfied, the engine is under operation, and the temperature of the exhaust gas on the upstream side of the exhaust heat recovery system 160 is higher than or equal to the third predetermined temperature (e.g., 300 degrees Celsius).

When the fifth diagnosis condition is satisfied, the controller 60 may apply a control signal so that the second bypass valve 131 is closed to preset amount (e.g., a closed ratio of 85%), (or, apply a control signal so that the second bypass valve 131 is opened to preset amount (e.g., an open ratio of 15%)), and may diagnose whether the second bypass valve 131 and the third temperature sensor 113 are abnormal based on a temperature range of the third measured temperature.

For such a purpose, the controller 60 may compare the third measured temperature with a fifth comparison temperature (e.g., 180 degrees Celsius) and a sixth comparison temperature (e.g., 70 degrees Celsius), at step S620.

Figure 15A:
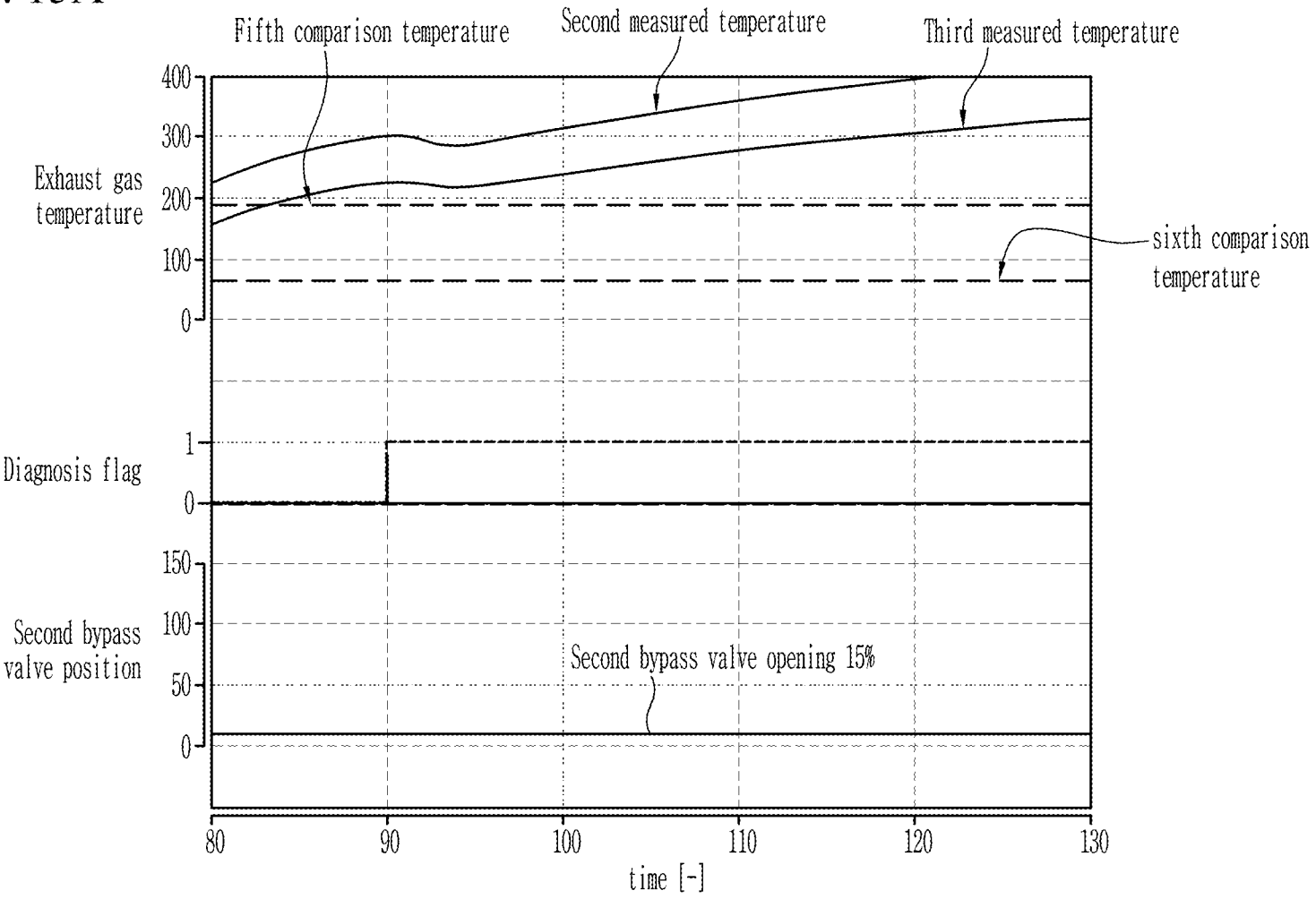
FIGS. 15A-15B are graphs explaining the diagnosis method of FIG. 14.

When the third measured temperature is higher than or equal to the fifth comparison temperature, the controller 60 may determine that the second bypass valve 131 and the third temperature sensor 113 are normal, at step S630 (see FIG. 15A).

Figure 15B:
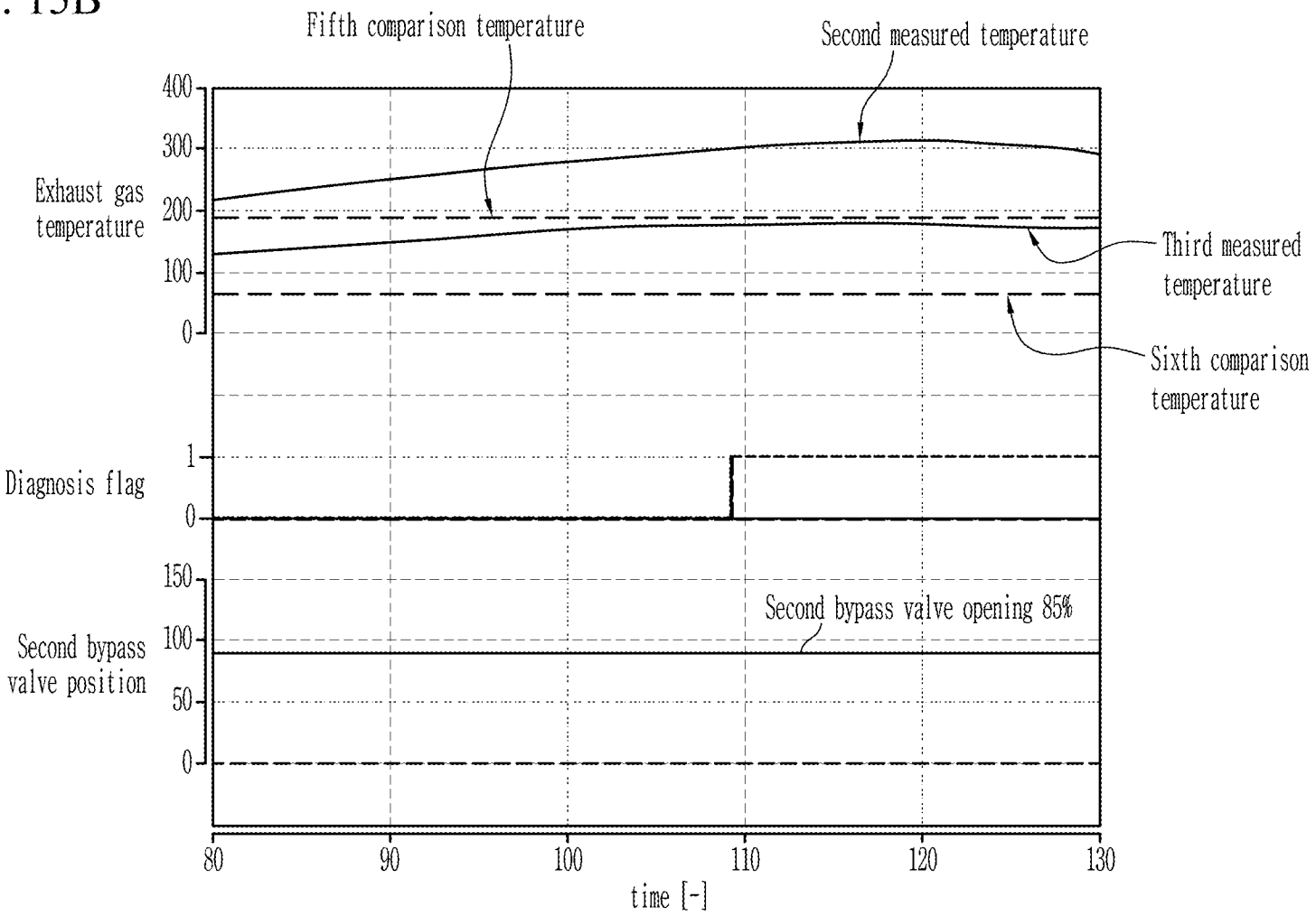

When the third measured temperature is lower than the fifth comparison temperature and higher than or equal to the sixth comparison temperature, the controller 60 may determine the second bypass valve 131 to be abnormal, at step S640 (see FIG. 15B). The controller 60 may notify a driver, through the display unit 70, that an abnormality of the second bypass valve 131 has occurred.

When the second measured temperature is higher than or equal to the third predetermined temperature (300 degrees Celsius), if the third measured temperature is lower than or equal to the fifth comparison temperature (180 degrees Celsius), the temperature of the exhaust gas heat-exchanged by the exhaust heat recovery system 160 may be determined to be excessively low, and in this case, the controller 60 may determine that the opening of the second bypass valve 131 is abnormal.

When the third measured temperature is lower than the sixth comparison temperature, the controller 60 may determine the third temperature sensor 113 to be abnormal, at step S650. The controller 60 may notify the drive that an abnormality has occurred in the third temperature sensor 113, through the display unit 70. When the second measured temperature is higher than or equal to the third predetermined temperature (300 degrees Celsius), if the third measured temperature is lower than or equal to the sixth comparison temperature (70 degrees Celsius), the third measured temperature may be determined to be excessively low, and in this case, the controller 60 may determine that an abnormality has occurred in the third temperature sensor 113.

According to a diagnosis apparatus of a post-processing system according to an embodiment of the present disclosure described above, it is possible to diagnose whether the first temperature sensor 111 to the third temperature sensor 113, the first bypass valve 121, and the second bypass valve 131 are abnormal.

Figure 16:
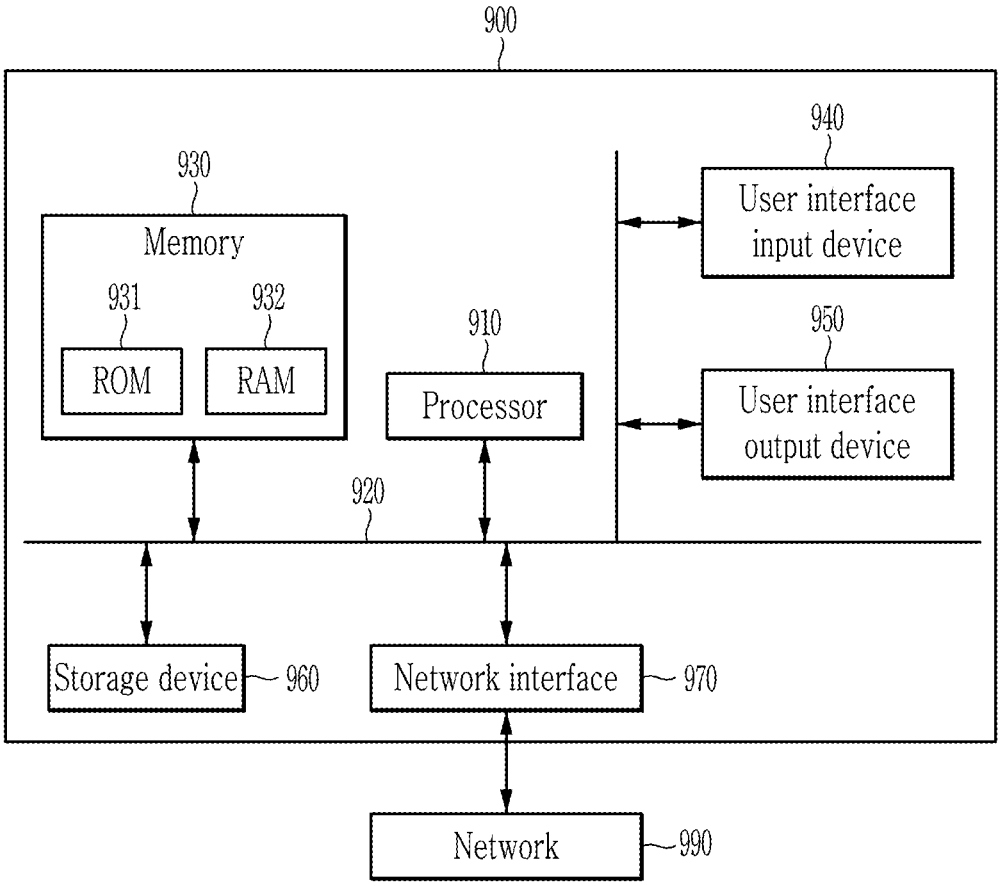
FIG. 16 is a diagram explaining a computing device according to an embodiment of the present disclosure.

FIG. 16 is a diagram for explaining a computing device according to an embodiment of the present disclosure.

Referring to FIG. 16, a method for diagnosing a post-processing system according to an embodiment of the present disclosure may be implemented by using a computing device 900.

The computing device 900 may include at least one of a processor 910, a memory 930, the user interface input device 940, the user interface output device 950 and a storage device 960 that communicate through a bus 920. The computing device 900 may also include a network interface 970 electrically connected to a network 990. The network interface 970 may transmit or receive signals with other entities through the network 990.

The processor 910 may be implemented in various types such as a micro controller unit (MCU), an application processor (AP), a central processing unit (CPU), a graphic processing unit (GPU), a neural processing unit (NPU), and the like, and may be any type of semiconductor device capable of executing instructions stored in the memory 930 or the storage device 960. The processor 910 may be configured to implement the functions and methods described above with respect to FIGS. 1-16.

The memory 930 and the storage device 960 may include various types of volatile or non-volatile storage media. For example, the memory may include a read-only memory (ROM) 931 and a random access memory (RAM) 932. In an embodiment of the present disclosure, the memory 930 may be located inside or outside processor 910, and the memory 930 may be connected to the processor 910 through various known means.

In some embodiments of the present disclosure, at least some components or functions of the diagnosis apparatus of a post-processing system according to embodiments may be implemented as a program or software executed by the computing device 900 or the program or software may be stored in a computer readable medium.

In some embodiments, at least some components or functions of a diagnosis apparatus of a post-processing system according to embodiments may be implemented using hardware or circuit of the computing device 900 or may be implemented as separate hardware or circuit that may be electrically connected to the computing device 900.

Although an embodiment of the present disclosure has been described, the present disclosure is not limited thereto, and it is possible to carry out various modifications within the scope of the claims, the detailed description of the disclosure, and the accompanying drawings, and the modifications belong to the scope of the present disclosure as a matter of course.

DESCRIPTION OF SYMBOLS

10: engine
11: Cylinder
20: First motor
30: Second motor
40: clutch
50: transmission
60: Controller
70: Display unit
100: Post-processing system
110: exhaust line
111: first temperature sensor
112: second temperature sensor
113: third temperature sensor
114: Ambient air temperature sensor
120: main bypass line
121: the first bypass valve
130: auxiliary bypass line
131: the second bypass valve
140: WCC catalyst
150: FCNT catalyst
160: exhaust heat recovery system
170: the LNT catalyst

What is claimed is:

1. An apparatus for diagnosing a post-processing system, the apparatus comprising:

a first catalyst, an exhaust heat recovery system, and a second catalyst sequentially disposed on an exhaust line;

a main bypass line branched from the exhaust line between the first catalyst and the exhaust heat recovery system and joining to the exhaust line on a downstream side of the second catalyst;

an auxiliary bypass line branched from the exhaust line between the first catalyst and the exhaust heat recovery system and joining to the exhaust line between the exhaust heat recovery system and the second catalyst;

a first bypass valve installed at a location where the exhaust line and the main bypass line join;

a second bypass valve installed at a location where the exhaust line and the auxiliary bypass line join; and a controller configured to determine whether at least one of a first temperature sensor, a second temperature sensor, a third temperature sensor, the first bypass valve, or the second bypass valve is abnormal, based on whether a predetermined diagnosis condition is satisfied, wherein the first temperature sensor is configured to measure a temperature of an exhaust gas on an upstream side of the first bypass valve, the second temperature sensor is configured to measure a temperature of the exhaust gas on an upstream side of the exhaust heat recovery system, and the third temperature sensor is configured to measure a temperature of the exhaust gas on the downstream side of the exhaust heat recovery system.

2. The apparatus of claim 1, wherein the predetermined diagnosis condition comprises:

a preliminary diagnosis condition for verifying validity of the first temperature sensor, the second temperature sensor, and the third temperature sensor;

a first diagnosis condition for diagnosing whether the first temperature sensor is abnormal;

a second diagnosis condition for diagnosing whether the second temperature sensor is abnormal;

a third diagnosis condition for diagnosing whether the third temperature sensor is abnormal;

a fourth diagnosis condition for diagnosing whether the first bypass valve is abnormal; and a fifth diagnosis condition for diagnosing whether the exhaust heat recovery system is abnormal.

3. The apparatus of claim 2, wherein:

the preliminary diagnosis condition is satisfied when a stop duration of an engine is greater than or equal to a predetermined time;

the first diagnosis condition is satisfied when the temperature measured by the first temperature sensor, the temperature measured by the second temperature sensor, and the temperature measured by the third temperature sensor while the preliminary diagnosis condition is satisfied is preliminarily verified to be valid, and the engine is under operation;

the second diagnosis condition is satisfied when the first temperature sensor is determined to be normal, the engine is under operation, and the temperature of the exhaust gas on the upstream side of the first bypass valve is greater than or equal to a first predetermined temperature, while the first diagnosis condition is satisfied;

the third diagnosis condition is satisfied when the second temperature sensor is determined to be normal, the engine is under operation, and the temperature of the exhaust gas on the upstream side of the exhaust heat recovery system is greater than or equal to a second predetermined temperature, and the first bypass valve is opened, while the second diagnosis condition is satisfied;

the fourth diagnosis condition is satisfied when the third temperature sensor is determined to be normal, the engine is under operation, and the temperature of the exhaust gas on the upstream side of the exhaust heat recovery system is greater than or equal to a third predetermined temperature, while the third diagnosis condition is satisfied; and the fifth diagnosis condition is satisfied when the first bypass valve and the second temperature sensor are determined to be normal, the engine is under operation, and the temperature of the exhaust gas on the upstream side of the exhaust heat recovery system is greater than or equal to the third predetermined temperature, while the fourth diagnosis condition is satisfied.

4. The apparatus of claim 3, wherein, when the first diagnosis condition is satisfied, the controller is configured to determine whether the first temperature sensor is abnormal by comparing a difference between the temperature of the exhaust gas measured by the first temperature sensor and a modeling temperature.

5. The apparatus of claim 4, wherein, when the difference between the temperature of the exhaust gas measured by the first temperature sensor and the modeling temperature is lower than a second comparison temperature, the controller determines the first temperature sensor to be normal.

6. The apparatus of claim 5, wherein, when the difference between the temperature of the exhaust gas measured by the first temperature sensor and the modeling temperature is greater than or equal to the second comparison temperature, the controller determines the first temperature sensor to be abnormal.

7. The apparatus of claim 3, wherein, when the second diagnosis condition is satisfied, the controller determines whether the second temperature sensor is abnormal by comparing the temperature of the exhaust gas measured by the first temperature sensor with the temperature of the exhaust gas measured by the second temperature sensor.

8. The apparatus of claim 7, wherein, when the temperature of the exhaust gas measured by the first temperature sensor is greater than or equal to the temperature of the exhaust gas measured by the second temperature sensor, the controller determines the second temperature sensor to be normal.

9. The apparatus of claim 8, wherein, when the temperature of the exhaust gas measured by the first temperature sensor is lower than the temperature of the exhaust gas measured by the second temperature sensor, the controller determines the second temperature sensor to be abnormal.

10. The apparatus of claim 3, wherein, when the third diagnosis condition is satisfied, the controller is configured to compare the temperature of the exhaust gas measured by the second temperature sensor with the temperature of the exhaust gas measured by the third temperature sensor, to determine whether the third temperature sensor is abnormal.

11. The apparatus of claim 10, wherein, when the temperature of the exhaust gas measured by the second temperature sensor is greater than or equal to the temperature of the exhaust gas measured by the third temperature sensor, the controller determines the third temperature sensor to be normal.

12. The apparatus of claim 11, wherein, when the temperature of the exhaust gas measured by the second temperature sensor is lower than the temperature of the exhaust gas measured by the third temperature sensor, the controller determines the third temperature sensor to be abnormal.

13. The apparatus of claim 3, wherein, when the fourth diagnosis condition is satisfied, the controller is configured to:

apply a control signal to close the first bypass valve;

compare the temperature of the exhaust gas measured by the first temperature sensor with the temperature of the exhaust gas measured by the second temperature sensor;

compare the temperature of the exhaust gas measured by the second temperature sensor with the temperature of the exhaust gas measured by the third temperature sensor; and determine whether the first bypass valve and the second temperature sensor are abnormal.

14. The apparatus of claim 13, wherein, when a difference between the temperature of the exhaust gas measured by the first temperature sensor and the temperature of the exhaust gas measured by the second temperature sensor is lower than a third comparison temperature, and a difference between the temperature of the exhaust gas measured by the second temperature sensor and the temperature of the exhaust gas measured by the third temperature sensor is greater than or equal to a fourth comparison temperature, the controller determines the first bypass valve to be normal.

15. The apparatus of claim 13, wherein, when a difference between the temperature of the exhaust gas measured by the first temperature sensor and the temperature of the exhaust gas measured by the second temperature sensor is greater than or equal to a third comparison temperature, and a difference between the temperature of the exhaust gas measured by the second temperature sensor and the temperature of the exhaust gas measured by the third temperature sensor is lower than a fourth comparison temperature, the controller determines the first bypass valve to be abnormal.

16. The apparatus of claim 13, wherein, when a difference between the temperature of the exhaust gas measured by the first temperature sensor and the temperature of the exhaust gas measured by the second temperature sensor is greater than or equal to a third comparison temperature and a difference between the temperature of the exhaust gas measured by the second temperature sensor and the temperature of the exhaust gas measured by the third temperature sensor is greater than or equal to a fourth comparison temperature, the controller determines the second temperature sensor to be abnormal.

17. The apparatus of claim 3, wherein, when the fifth diagnosis condition is satisfied, the controller determines whether the second bypass valve and the third temperature sensor are abnormal based on the temperature of the exhaust gas measured by the third temperature sensor.

18. The apparatus of claim 17, wherein, when the temperature of the exhaust gas measured by the third temperature sensor is lower than a fifth comparison temperature and greater than or equal to a sixth comparison temperature, the controller is configured to determine that the exhaust heat recovery system is normal.

19. The apparatus of claim 17, wherein, when the temperature of the exhaust gas measured by the third temperature sensor is lower than a fifth comparison temperature and greater than or equal to a sixth comparison temperature, the controller determines the second bypass valve to be abnormal.

20. The apparatus of claim 17, wherein, when the temperature of the exhaust gas measured by the third temperature sensor is lower than a sixth comparison temperature, the controller determines the third temperature sensor to be abnormal.

* * * * *